US009878543B2

(12) United States Patent
Harada et al.

(10) Patent No.: US 9,878,543 B2
(45) Date of Patent: Jan. 30, 2018

(54) LIQUID EJECTING APPARATUS WITH FLUSHING RECEPTIVE BODY FOR RECEIVING LIQUID DURING MAINTENANCE OPERATION

(71) Applicant: SEIKO EPSON CORPORATION, Tokyo (JP)

(72) Inventors: Koji Harada, Shiojiri (JP); Shigeki Suzuki, Shiojiri (JP); Kinya Ozawa, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/295,721

(22) Filed: Oct. 17, 2016

(65) Prior Publication Data

US 2017/0113463 A1 Apr. 27, 2017

(30) Foreign Application Priority Data

Oct. 21, 2015 (JP) ..... 2015-207379

(51) Int. Cl.
*B41J 2/165* (2006.01)

(52) U.S. Cl.
CPC ..... *B41J 2/1652* (2013.01); *B41J 2/16508* (2013.01); *B41J 2/16523* (2013.01); *B41J 2/16526* (2013.01); *B41J 2002/16573* (2013.01)

(58) Field of Classification Search
CPC .... B41J 2/1652; B41J 2/16597; B41J 2/1721; B41J 2/1742; B41J 2/1707; B41J 2/16526; B41J 2002/16573; B41J 2/16523; B41J 2/16508
See application file for complete search history.

(56) References Cited

U.S. PATENT DOCUMENTS

2010/0283815 A1* 11/2010 Watanabe ..... B41J 2/1721 347/30
2012/0306971 A1* 12/2012 Kobashi ..... B41J 2/16508 347/54
2013/0241995 A1* 9/2013 Maruyama ..... B41J 2/1652 347/36

FOREIGN PATENT DOCUMENTS

| | | |
|---|---|---|
| JP | 2007-111932 | 5/2007 |
| JP | 2008-168525 | 7/2008 |
| JP | 2010-036382 | 2/2010 |
| JP | 2011-161653 | 8/2011 |
| JP | 2012-240257 | 12/2012 |
| JP | 2012-245714 | 12/2012 |

* cited by examiner

*Primary Examiner* — Henok Legesse
(74) *Attorney, Agent, or Firm* — Workman Nydegger

(57) ABSTRACT

A liquid ejecting apparatus includes a liquid ejecting portion which has a nozzle that ejects liquid, and a flushing receptive body which receives the liquid that is ejected in a flushing operation in which the liquid is ejected from the nozzle, the flushing receptive body including a receiving member that is able to receive the liquid, a receiving member holding portion which holds the receiving member, and a fixing member with conductivity that fixes the receiving member to the receiving member holding portion by contacting the receiving member and has a mesh form portion that forms an adhesion surface to which the ejected liquid is adhered with the receiving member in the flushing operation, in which the fixing member is electrically grounded.

10 Claims, 14 Drawing Sheets

FIG. 15

| MEDIUM | PG (mm) | TEMPERATURE/ HUMIDITY | MIST ADHESION DEGREE | CHARGE AMOUNT (V) ON PRINTING SURFACE | CHARGE AMOUNT (V) ON NON-PRINTING SURFACE | AMOUNT OF INCREASE IN CHARGE (V) |
|---|---|---|---|---|---|---|
| M1 | 2.00<br>1.65 | 20°C/60%<br>20°C/30% | MINIMUM<br>MINIMUM | 351.9<br>371.9 | 51.8<br>112.8 | 300.1<br>259.2 |
| M2 | 2.00 | 20°C/30% | MINIMUM | 116.4 | −49.1 | 165.5 |
| M3 | 1.65<br>1.65 | 20°C/30%<br>20°C/30% | MIDDLE (*1)<br>MAXIMUM | 903.5<br>879.3 | −307.8<br>−267.2 | 1211.3<br>1146.4 |
| M4 | 1.65<br>2.00 | 20°C/30%<br>20°C/60% | MIDDLE TO LOW<br>LOW | 885.1<br>604.6 | 269.1<br>282.8 | 616.0<br>321.8 |
| M5 | 2.00 | 20°C/30% | MIDDLE | 684.7 | 611.8 | 72.9 |

FIG. 16

| MEDIUM | PG (mm) | FIRST COEFFICIENT A | SECOND COEFFICIENT B | THIRD COEFFICIENT C | A×B×C | A×B |
|---|---|---|---|---|---|---|
| M1 | 1.65 | 0.3 | 1.0 | 1.1 | 0.33 | 0.30 |
| | 2.00 | ↑ | 2.0 | ↑ | 0.66 | 0.60 |
| | 2.50 | ↑ | 2.5 | ↑ | 0.83 | 0.75 |
| M2 | 1.65 | 0.2 | 1.0 | 1.1 | 0.22 | 0.20 |
| | 2.00 | ↑ | 2.0 | ↑ | 0.44 | 0.40 |
| | 2.50 | ↑ | 2.5 | ↑ | 0.55 | 0.50 |
| M3 | 1.65 | 1.0 | 1.0 | 1.0 | 1.00 | 1.00 |
| | 2.00 | ↑ | 2.0 | ↑ | 2.00 | 2.00 |
| | 2.50 | ↑ | 2.5 | ↑ | 2.50 | 2.50 |
| M4 | 1.65 | 0.4 | 1.0 | 1.2 | 0.48 | 0.40 |
| | 2.00 | ↑ | 2.0 | ↑ | 0.96 | 0.80 |
| | 2.50 | ↑ | 2.5 | ↑ | 1.20 | 1.00 |
| M5 | 1.65 | 0.2 | 1.0 | 2.0 | 0.40 | 0.20 |
| | 2.00 | ↑ | 2.0 | ↑ | 0.80 | 0.40 |
| | 2.50 | ↑ | 2.5 | ↑ | 1.00 | 0.50 |

FIG. 17

| MEDIUM | NUMBER OF LIQUID DROPLETS (shot) BY WHICH ROUTINE CL IS CARRIED OUT DEPENDING ON PG | | |
|---|---|---|---|
| | PG1.65 | PG2.0 | PG2.5 |
| M1 | 33300000000 | 16600000000 | 13300000000 |
| M2 | 50000000000 | 25000000000 | 20000000000 |
| M3 | 10000000000 | 5000000000 | 4000000000 |
| M4 | 25000000000 | 12500000000 | 10000000000 |
| M5 | 50000000000 | 25000000000 | 20000000000 |

FIG. 18

| MEDIUM | NUMBER OF LIQUID DROPLETS (shot) BY WHICH ROUTINE CL IS CARRIED OUT DEPENDING ON PG | | |
|---|---|---|---|
| | PG1.65 | PG2.0 | PG2.5 |
| M1 | 30300000000 | 15100000000 | 12000000000 |
| M2 | 45400000000 | 22700000000 | 18100000000 |
| M3 | 10000000000 | 5000000000 | 4000000000 |
| M4 | 20800000000 | 10400000000 | 8300000000 |
| M5 | 25000000000 | 12500000000 | 10000000000 |

FIG. 19

| MEDIUM | NUMBER OF LIQUID DROPLETS (shot) BY WHICH ROUTINE CL IS CARRIED OUT DEPENDING ON PG | | |
|---|---|---|---|
| | PG1.65 | PG2.0 | PG2.5 |
| M1 | 20000000000 (33300000000) | 10000000000 (16600000000) | 10000000000 (13300000000) |
| M2 | 20000000000 (50000000000) | 10000000000 (25000000000) | 10000000000 (20000000000) |
| M3 | 10000000000 (10000000000) | 5000000000 (5000000000) | 4000000000 (4000000000) |
| M4 | 20000000000 (25000000000) | 10000000000 (12500000000) | 10000000000 (10000000000) |
| M5 | 20000000000 (50000000000) | 10000000000 (25000000000) | 10000000000 (20000000000) |

FIG. 20

| MEDIUM | PRINTING SURFACE AREA ($m^2$) IN WHICH ROUTINE CL IS CARRIED OUT DEPENDING ON PG | | |
|---|---|---|---|
| | PG1.65 | PG2.0 | PG2.5 |
| M1 | 2S (20000000000) | S (10000000000) | S (10000000000) |
| M2 | 2S (20000000000) | S (10000000000) | S (10000000000) |
| M3 | S (10000000000) | 0.4S (5000000000) | 0.4S (4000000000) |
| M4 | 2S (20000000000) | S (10000000000) | S (10000000000) |
| M5 | 2S (20000000000) | S (10000000000) | S (10000000000) |

LIQUID EJECTING APPARATUS WITH FLUSHING RECEPTIVE BODY FOR RECEIVING LIQUID DURING MAINTENANCE OPERATION

BACKGROUND

1. Technical Field

The present invention relates to a liquid ejecting apparatus and a flushing receptive body.

2. Related Art

From the related art, as a type of liquid ejecting apparatus, an ink jet printer is widely known which performs recording by ejecting an ink droplet (liquid) from a nozzle which is formed on a liquid ejecting head on a target such as a paper sheet. In such a printer, in order to suppress clogging and the like of the nozzle of the recording head (liquid ejecting head), flushing is performed in which the ink droplet is ejected (that is, discharged) as waste ink (waste liquid) from the nozzle based on a driving signal unrelated to recording on the target.

For example, a liquid ejecting apparatus described in JP-A-2007-111932 has a configuration in which an ejection characteristic of a recording head is recovered by ejecting an ink droplet from a nozzle with respect to a flushing box that is provided in a flushing region outside of a printing region in which paper is supported on a platen. In addition, in JP-A-2008-168525, a flushing box (liquid receiving device) is disclosed that has a fixing member with a bottomed box-shape that is able to receive waste ink, an ink absorber which is able to absorb an ink droplet in a state of being accommodated within the fixing member, and a wire mesh member which is fastened to an opening portion of the fixing member so as to be able to suppress lifting up of the ink absorber from within the fixing member.

There is a tendency for the ink droplet which is ejected from the nozzle to have a strong positive charge during flight due to the Leonard effect. For this reason, when the ink droplet which is ejected on the flushing box is charged and is retained on an ink receiving surface of the flushing box in a charged state, repellence and misting occurs due to the retained ink droplet and the ejected ink droplet being charged with the same polarity. Furthermore, since the distance between the nozzle surface and an ink receiving surface is close, the misted ink droplet is adhered to the nozzle surface. In this manner, there is a possibility of there being an adverse effect on ejection of the ink droplet from the nozzle during printing due to the misted ink droplet adhering to the nozzle surface.

SUMMARY

An advantage of some aspects of the invention is to provide a liquid ejecting apparatus and a flushing receptive body in which it is possible to suppress an adverse effect on ejection of the ink droplet.

The invention has adopted the following configuration.

According to an aspect of the invention, there is provided a liquid ejecting apparatus that has a liquid ejecting portion, which has a nozzle formation surface on which a nozzle that ejects liquid is formed, and ejects the liquid on a medium from the nozzle, and a flushing receptive body which receives the liquid that is ejected in a flushing operation in which the liquid is ejected from the nozzle as a maintenance operation of the liquid ejecting portion, and the flushing receptive body includes a receiving member that is able to receive the liquid, a receiving member holding portion which holds the receiving member such that the receiving member faces the nozzle formation surface in the flushing operation, and a fixing member with conductivity that fixes the receiving member to the receiving member holding portion by contacting the receiving member, and in the flushing operation, is positioned on the nozzle formation surface side due to the receiving member, and has a mesh form portion that forms an adhesion surface to which the ejected liquid is adhered with the receiving member, in which the fixing member is electrically grounded.

Accordingly, in the liquid ejecting apparatus of the invention, since the fixing member is electrically grounded, it is possible to reduce occurrence of repellence and misting due to the ink that is retained on an adhesion surface and the ejected ink droplet being charged with the same polarity.

In the liquid ejecting apparatus, it is preferable to include a medium support portion which supports the medium when the liquid is ejected on the medium, in which a distance between the nozzle formation surface and the adhesion surface in the flushing operation is larger than a distance between the nozzle formation surface and the medium support portion in ejection on the medium.

Accordingly, in the liquid ejecting apparatus of the invention, in the flushing operation, even in a case where the ejected liquid is misted, it is possible to reduce adhesion to the nozzle formation surface.

In the liquid ejecting apparatus, it is preferable that the receiving member holding portion has a side wall that is provided to surround the receiving member, in which the side wall includes a region in which a distance to the nozzle formation surface in the flushing operation is the same as or larger than a distance between the nozzle formation surface and the adhesion surface of the fixing member.

Accordingly, in the liquid ejecting apparatus of the invention, in the flushing operation, even in a case where the ejected liquid is misted, it is possible to reduce adhesion to the nozzle formation surface since mist tends not to be retained in a space between the nozzle formation surface and the side wall of the adhesion surface and receiving member holding portion.

In the liquid ejecting apparatus, it is preferable that the receiving member holding portion has a locking portion that is formed by a conductive member and locks a locked portion of the fixing member, and the fixing member is electrically grounded via the receiving member holding portion.

Accordingly, in the liquid ejecting apparatus of the invention, it is possible to appropriately adopt a configuration in which the fixing member is electrically grounded. In addition, in the liquid ejecting apparatus of the invention, the liquid which is held by the receiving member tends to be electrically grounded.

In the liquid ejecting apparatus, it is preferable to include a flushing receptive body mounting body which holds the flushing receptive body to be attachable and detachable, and a grounding member which has conductivity that is fixed to the flushing receptive body mounting body so as to contact the receiving member holding portion when the flushing receptive body is mounted on the flushing receptive body mounting body.

Accordingly, in the liquid ejecting apparatus of the invention, it is possible to appropriately adopt a configuration in which the fixing member is electrically grounded and the flushing receptive body is replaceable.

According to another aspect of the invention, there is provided a flushing receptive body receiving liquid that is ejected in a flushing operation in which the liquid is ejected from a nozzle as a maintenance operation of a liquid ejecting portion that has a nozzle formation surface on which the nozzle that ejects the liquid is formed, and ejects the liquid on the medium from the nozzle, the flushing receptive body including a receiving member that is able to receive the liquid, a receiving member holding portion which holds the receiving member such that the receiving member faces the nozzle formation surface in the flushing operation, and a fixing member with conductivity that fixes the receiving member to the receiving member holding portion by contacting the receiving member, and in the flushing operation, is positioned on the nozzle formation surface side due to the receiving member, and has a mesh form portion that forms an adhesion surface to which the ejected liquid is adhered with the receiving member, in which the receiving member holding portion has a locking portion that is formed by a conductive member and locks a locked portion of the fixing member, and has a grounded portion that is able to contact a grounding member in order to electrically ground the fixing member.

Accordingly, in the flushing receptive body of the invention, since the fixing member is electrically grounded, it is possible to reduce occurrence of repellence and misting due to the ink that is retained on the adhesion surface and the ejected ink droplet being charged with the same polarity.

BRIEF DESCRIPTION OF THE DRAWINGS

The invention will be described with reference to the accompanying drawings, wherein like numbers reference like elements.

FIG. 15 is a view illustrating a distance PG, temperature and humidity, mist adhesion degree, amount of charge on a printing surface, amount of charge on a non-printing surface, and an amount of increase in charge in each medium.

FIG. 16 is a view illustrating the distance PG, first to third coefficients, a product of the first and second coefficients, and a product of the first to third coefficients in each medium.

FIG. 17 is a view illustrating a relationship between the distance PG in each medium and a liquid droplet number by which a maintenance operation is carried out according to a first embodiment.

FIG. 18 is a view illustrating a relationship between the distance PG in each medium and a liquid droplets number by which a maintenance operation is carried out according to a second embodiment.

FIG. 19 is a view illustrating a relationship between the distance PG in each medium and a liquid droplet number by which a maintenance operation is carried out according to a third embodiment.

FIG. 20 is a view illustrating a relationship between the distance PG in each medium and a printing surface area on which a maintenance operation is carried out according to a fourth embodiment.

DESCRIPTION OF EXEMPLARY EMBODIMENTS

Figure 1:
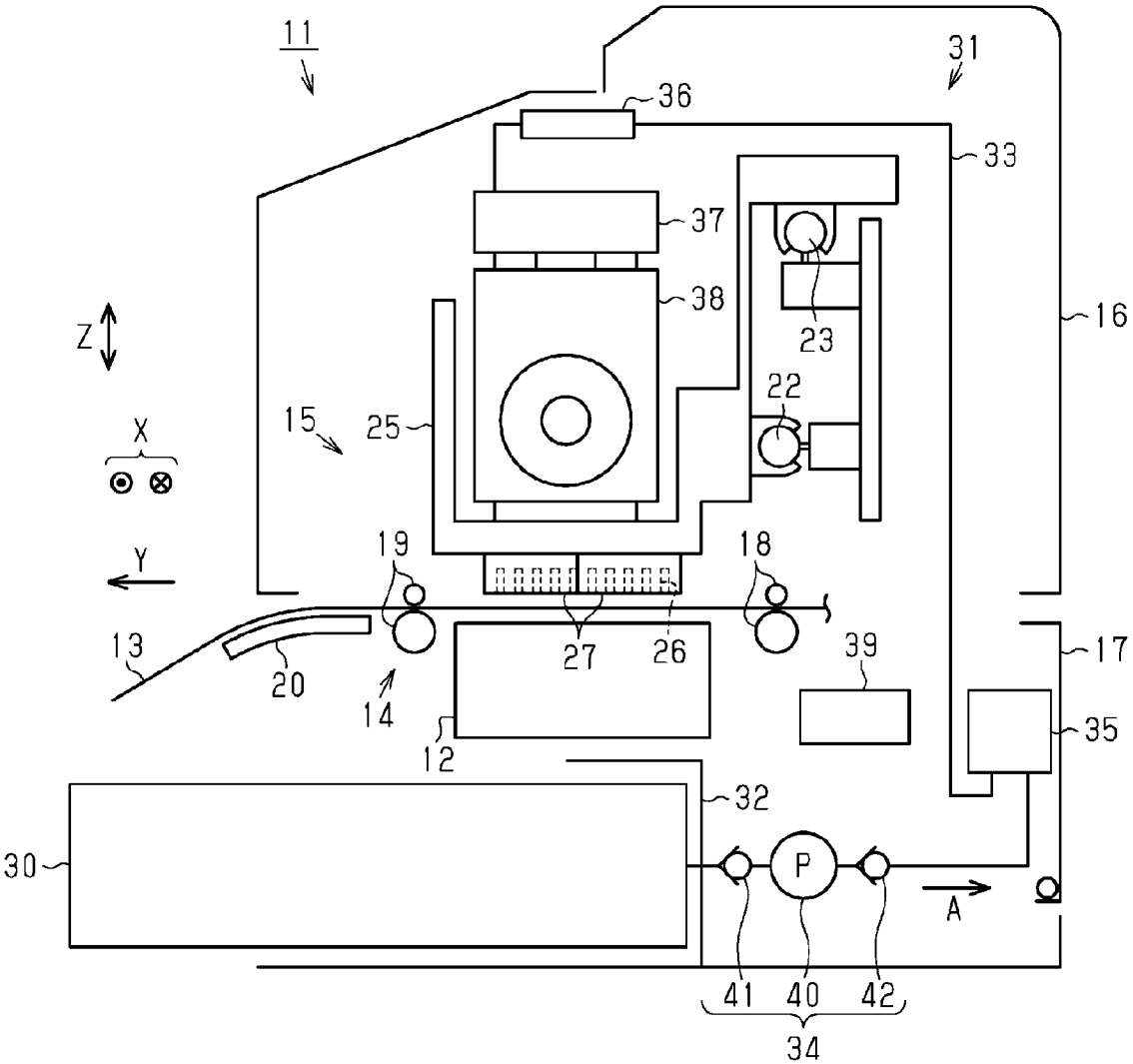
FIG. 1 is a schematic view illustrating a schematic configuration of an ink jet printer of a first embodiment.

Embodiments of a liquid ejecting apparatus and a flushing receptive body of the invention will be described below with reference to FIGS. 1 to 20.

Note that, the embodiments below illustrate an aspect of the invention, but are not limited to the invention, and are able to be arbitrarily modified within the scope of the technical concept of the invention. In addition, for ease of understanding of each configuration in the drawings below, scale, number, and the like are different in each configuration from the actual structure.

As shown in FIG. 1, an ink jet printer 11 as an example of the liquid ejecting apparatus is provided with a transport portion 14 which transports a recording medium (medium) 13 such as a paper sheet that is supported on a support base (medium support portion) 12 in a transport direction Y along a front surface of the support base 12 and a printing portion 15 which performs printing by ejecting ink as an example of liquid on the transported recording medium 13.

The support base 12, the transport portion 14, and the printing portion 15 are assembled on a printer main body 16 which is configured by a housing, a frame, and the like. In the ink jet printer 11, the support base 12 extends in a width direction of the recording medium 13 (X direction; direction orthogonal to a paper surface in FIG. 1). In addition, a cover 17 is attached to the printer main body 16 so as to be able to be opened and closed.

For example, the support base 12 is formed of anodized aluminum. The support base 12 has a heating device (not illustrated) which heats the recording medium 13. The support base 12 is electrically grounded. The support base 12 is provided with a floating prevention member 12A for preventing floating of an end portion in a width direction of the recording medium 13 (refer to FIG. 2, FIG. 2 only illustrates one side in the width direction). For example, the floating prevention member 12A is formed of stainless steel, and is provided to be movable in the width direction of the recording medium 13 synchronously to a printing operation by a printing portion 15.

The transport portion 14 is provided with transport roller pairs 18 and 19 which are respectively disposed on an upstream side and a downstream side of the support base 12 in the transport direction Y and a guide plate 20 which guides while supporting the recording medium 13 by being disposed on the downstream side of the transport roller pairs 19 in the transport direction Y. The recording medium 13 is transported in the transport direction Y along the front surface of the support base 12 and the front surface of the guide plate 20 by the transport roller pairs 18 and 19 being driven by a transport motor (illustration omitted) and rotating while interposing the recording medium 13 that is wound out from a roller (illustration omitted). Out of the transport roller pairs 18 and 19, a transport roller which contacts the opposite side (−Z side) from the ink adhesion surface side of the recording medium 13 is a driving roller, the front surface of which is formed of rubber. Out of the transport roller pairs 18 and 19, a transport roller which contacts the ink adhesion surface side (+Z side) of the recording medium 13 is a driven roller, and has a fluorine property or a fluorine processed surface.

Note that, for example, a stainless steel upstream side medium support portion (not illustrated) is provided on a transport path between the roller and the transport roller pair 18 which is guided to contact a rear side (non-printing side) of the recording medium 13. The upstream side medium support portion is provided with a heating device, and heats the recording medium 13 from the rear side to a predetermined temperature.

The printing portion 15 is provided with guide shafts 22 and 23 which extend along a scanning direction X that is a width direction of the recording medium 13 which is orthogonal to (intersects with) the transport direction Y of the recording medium 13 and a carriage 25 that is able to reciprocally move in the scanning direction X by being guided on the guide shafts 22 and 23. The carriage 25 reciprocally moves in the scanning direction X accompanying driving of a carriage motor (liquid ejecting portion moving apparatus) 24 (refer to FIG. 2).

At least one (two in the embodiment) liquid ejecting head (liquid ejecting portion) 27 that has the nozzle 26 which ejects ink is attached to a lower end portion of the carriage 25. That is, the liquid ejecting head 27 is attached to the carriage 25 at a posture with a lower surface placed facing a predetermined gap to the support base 12 in a vertical direction Z, and is reciprocally moved in the scanning direction X along with the carriage 25 accompanying driving of the carriage motor 24 (refer to FIG. 2). In addition, a distance between the liquid ejecting head 27 and the support base 12, that is, a gap between the nozzle formation surface 61 and the recording medium 13 (distance PG (described in detail below)) is modifiable by a gap changing device which is not illustrated. Each liquid ejecting head 27 is separated by a predetermined distance in the scanning direction X, and disposed so as to be deviated by a predetermined distance in the transport direction Y.

Meanwhile, a part of a supply mechanism 31 which supplies ink to the liquid ejecting head 27 from an ink cartridge 30 is attached to the upper side of the carriage 25. The supply mechanism 31 causes ink to flow along a supply direction A from the upstream side which is the ink cartridge 30 side toward the downstream side which is the liquid ejecting head 27 side. The ink cartridge 30 and the supply mechanism 31 are provided with at least one set (five sets in the embodiment) of each type of ink.

Five ink cartridges 30 are respectively mounted so as to freely attach and detach a plurality (five in the embodiment) of mounting portions 32, and accommodate respectively different colors (types) of ink. For example, each color of ink of cyan (C), magenta (M), yellow (Y), black (K), and white (W) are accommodated in each ink cartridge 30. Color printing and the like is performed on the recording medium 13 by ejecting ink which is supplied from each ink cartridge 30 from the liquid ejecting head 27. For example, in a case of a dark color recording medium 13, color printing is performed thereon after white printing (foundation printing) is performed.

The supply mechanism 31 is provided with a supply path 33 which supplies ink to the liquid ejecting head 27 from the ink cartridge 30. A supply pump 34 which causes ink to flow in the supply direction A, a filter unit 35 which captures air bubbles or foreign matter within ink, a static mixer 36 which stirs ink by changing flow of ink which flows along the supply path 33, a liquid retaining chamber 37 which retains ink, and a pressure adjustment unit 38 which adjusts ink pressure are provided in order from the upstream side on the supply path 33.

The supply pump 34 has a diaphragm pump 40 in which a pump chamber capacity is variable, an inlet valve 41 which is disposed further on the upstream side than the diaphragm pump 40, and a discharge valve 42 which is disposed further on the downstream side than the diaphragm pump 40. The inlet valve 41 and the discharge valve 42 permit ink flow to the downstream side, and are configured by a one direction valve which prohibits ink flow to the upstream side.

For this reason, the supply pump 34 suctions ink via the inlet valve 41 from the ink cartridge 30 side accompanying an increase in capacity of the pump chamber of the diaphragm pump 40 and discharges ink via the discharge valve 42 to the liquid ejecting head 27 accompanying a reduction of capacity of the pump chamber. In addition, the filter unit 35 is disposed at a position which corresponds to the cover 17 of the printer main body 16, and is mounted so as to be attachable and detachable with respect to the supply path 33. Then, the filter unit 35 is replaceable by opening the cover 17.

Note that, the ink jet printer 11 is provided with a control portion 39 which performs driving control of a transport motor (illustration omitted) which drives the transport roller pairs 18 and 19, the carriage motor 24 (refer to FIG. 2), the supply pump 34, and the like, ejection control of ink from each nozzle 26 of the liquid ejecting head 27, driving control of the gap changing device and the like. Then, the liquid ejecting head 27 performs printing by ejecting ink on the recording medium 13 which is transported on the support base 12 from each nozzle 26 while reciprocally moving in the scanning direction X along with the carriage 25 accompanying driving of the carriage motor 24.

Figure 2:
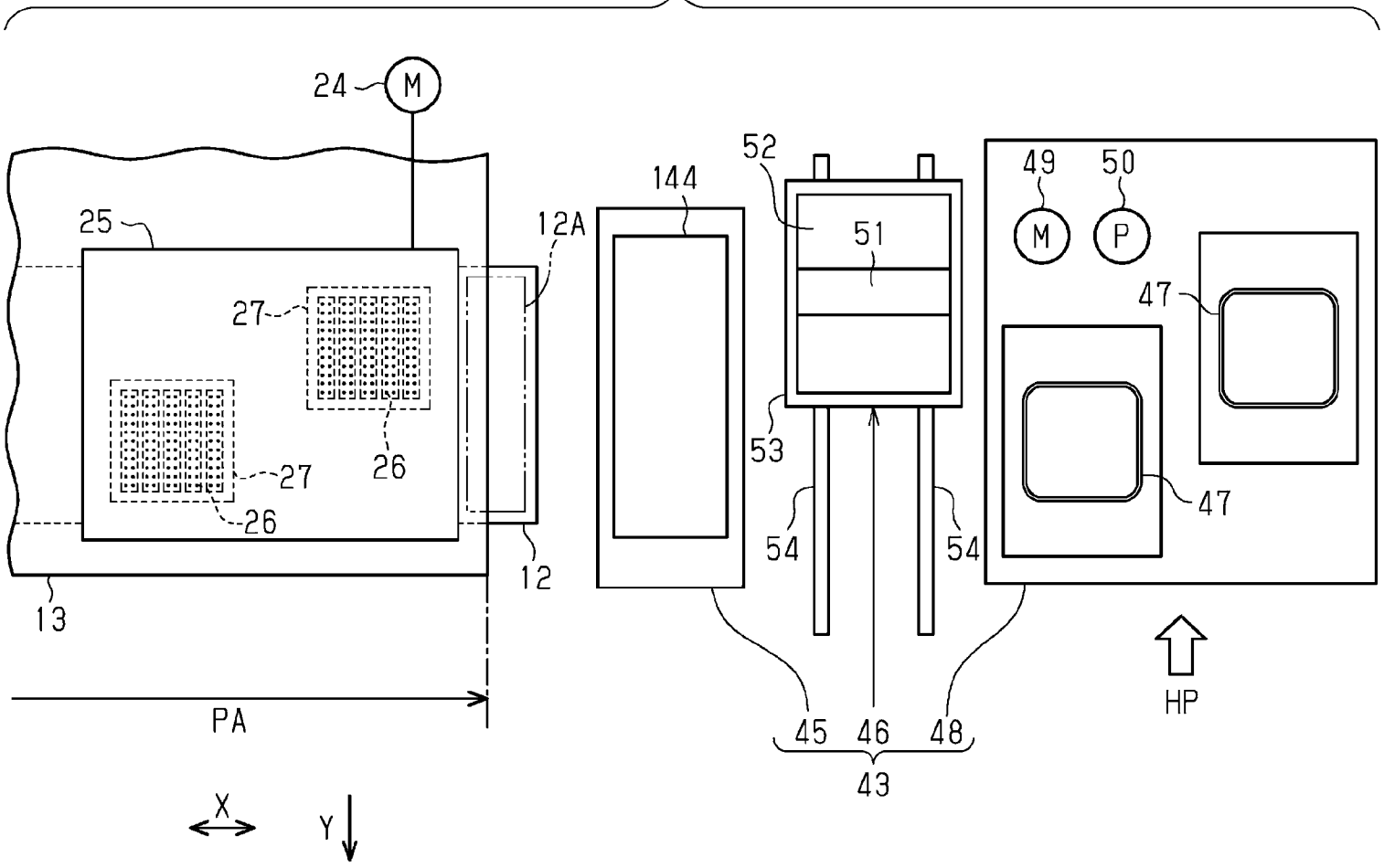
FIG. 2 is a schematic plan view illustrating a positional relationship of a support base and a maintenance portion.

As shown in FIG. 2, the maintenance portion 43 for performing maintenance of the liquid ejecting head 27 is provided at a position adjacent to one end of the support base 12 in the scanning direction X. In the embodiment, a region in which there is a possibility that the recording medium 13 is transported that is a region in which ink is ejected on the recording medium 13 in order for the liquid ejecting head 27 to print is a transport region PA. In this case, the maintenance portion 43 is disposed outside (right side in FIG. 2) of the transport region PA that is within a scanning range of the carriage 25 in the scanning direction X.

The maintenance portion 43 is provided with a flushing unit 45 that has a liquid receiving portion 144, a wiper unit 46 as an example of the cleaning device, and a capping unit 48 that has two cap portions 47 that have a bottomed rectangular box shape in which the upper end is open, disposed lined up in order from a position that is close to the transport region PA in the scanning direction X.

The carriage 25 and the liquid ejecting head 27 are in standby at a home position HP at which the capping unit 48 is disposed when printing is not performed, when the power is turned off, or the like. That is, the liquid ejecting head 27 is movable between the transport region PA and the home position HP in the scanning direction X which is orthogonal to (intersects with) the transport direction Y.

When two liquid ejecting heads 27 are moved to the home position HP, two cap portions 47 respectively face two liquid ejecting heads 27 in an up and down direction. Each cap portion 47 is raised and lowered between a position at which it is possible to contact each liquid ejecting head 27 and a position which is separated from each liquid ejecting head 27 by driving of a capping motor 49.

Each cap portion 47 suppresses drying of ink within each nozzle 26 by performing capping which forms a closed space at each liquid ejecting head 27 by contacting each liquid ejecting head 27 so as to surround a plurality of nozzles 26. Each liquid ejecting head 27 is capped by each cap portion 47 at the home position HP when printing is not performed and the like. It is preferable that the cap portion 47 is electrically grounded in order to contact the nozzle formation surface 61.

Within each cap portion 47, it is possible to suction using a suction pump 50 via a suction tube (illustration omitted) to which one end side is connected to each cap portion 47. Then, in a state in which each liquid ejecting head 27 is capped by each cap portion 47 at the home position HP, thickening of ink, air bubbles, and the like within each liquid ejecting head 27 are discharged within each cap portion 47 from each nozzle 26, so-called head cleaning is performed by suctioning within each cap portion 47 (closed space) by driving the suction pump 50. Discharge within each cap portion 47 is discharged to a waste ink tank (not illustrated). Note that, the capping motor 49 and the suction pump 50 are driven and controlled by the control portion 39 (refer to FIG. 1).

The wiper unit 46 is provided with a wiper cassette 52 in which a cloth sheet 51 is mounted as an example of the absorption member that is able to absorb ink by abutting on the lower surface of the liquid ejecting head 27 and a wiper holder 53 with a bottomed rectangular box shape to which an upper end is open to which the wiper cassette 52 is mounted so as to freely attach and detach. The wiper unit 46 is guided to be able to be reciprocally moved along the transport direction Y using a pair of rail portions 54.

In addition, the flushing unit 45 discharges an ink droplet from each nozzle 26 unrelated to printing as a maintenance operation with the object of preventing or eliminating clogging or the like of each nozzle 26, and receives flushing ink which is ejected when a so-called flushing operation is performed in a liquid receiving portion 144. Note that, the flushing unit 45 is disposed so as to be positioned below the liquid ejecting head 27 at the left side at which the liquid receiving portion 144 is in FIG. 2 when the liquid ejecting head 27 on the right side in FIG. 2 is positioned above the wiper unit 46.

Figure 3:
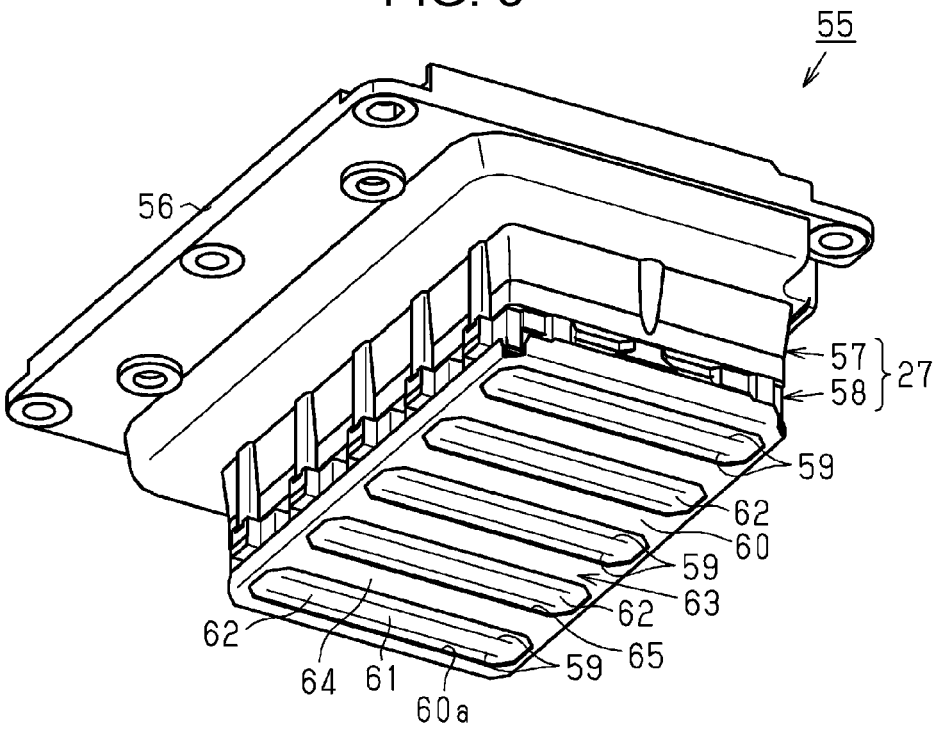
FIG. 3 is a perspective view of a head unit.

As shown in FIG. 3, since the head unit 55 is attached to a lower surface portion of the carriage 25, the head unit 55 is provided with a bracket portion 56 for attaching to the carriage 25 and the liquid ejecting head 27 with a rectangular cube shape which protrudes down from the bracket portion 56. The liquid ejecting head 27 is provided with a flow path forming portion 57 with a rectangular cube shape which protrudes down from the bracket portion 56 and a head main body 58 with a rectangular shape which is fixed to the lower side of the flow path forming portion 57. A plurality of rows (for example, 10 rows) of nozzle rows 59 are formed on the lower surface of the head main body 58 in FIG. 3.

In addition, a cover member 60 with a plate shape that has a plurality of (for example, five) through holes 60*a* is attached to the lower surface side of the head main body 58 so as to cover a portion of a nozzle formation surface 61 (lower surface in the present example) that is formed such that each nozzle 26 (refer to FIG. 4) that configures the nozzle row 59 is open. For example, the cover member 60 is formed of a stainless steel material. The plurality of nozzle rows 59 are exposed by a predetermined row number (for example, two rows) in one through hole 60*a*.

In the present example, a region which is exposed by the through hole 60*a* on the nozzle formation surface 61 is a nozzle peripheral region 62. That is, a surface of the nozzle 26 on the liquid ejecting head 27 is covered by the cover member 60 that has the through hole 60*a* that exposes the nozzle peripheral region 62 in a part that corresponds to the nozzle peripheral region 62. Note that, the opening region of each nozzle 26 (refer to FIG. 4) is included in the nozzle peripheral region 62.

Figure 4:
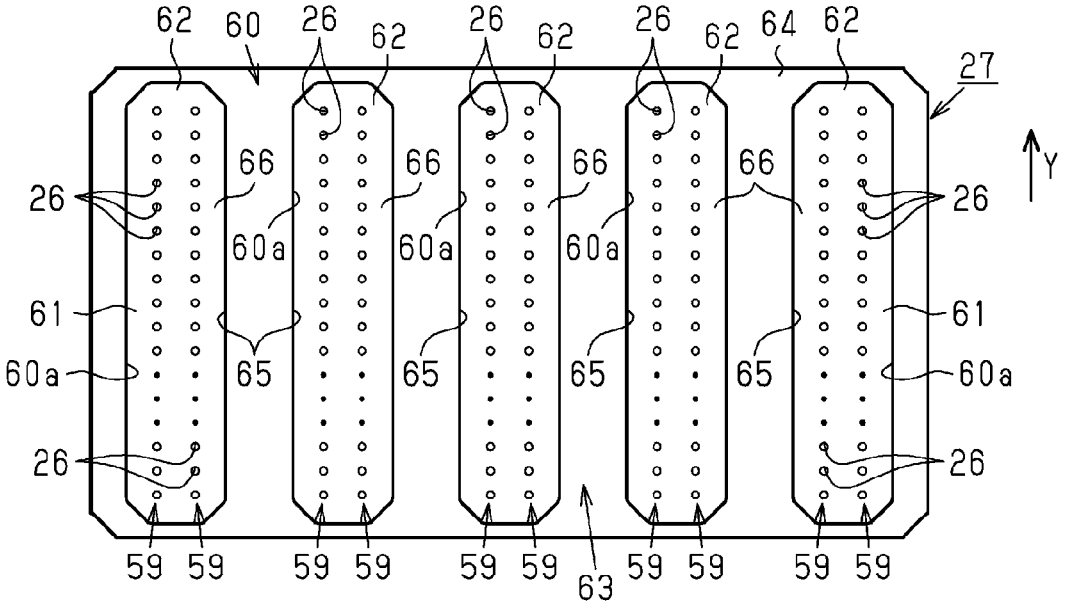
FIG. 4 is a schematic view of the nozzle surface.
Figure 5:
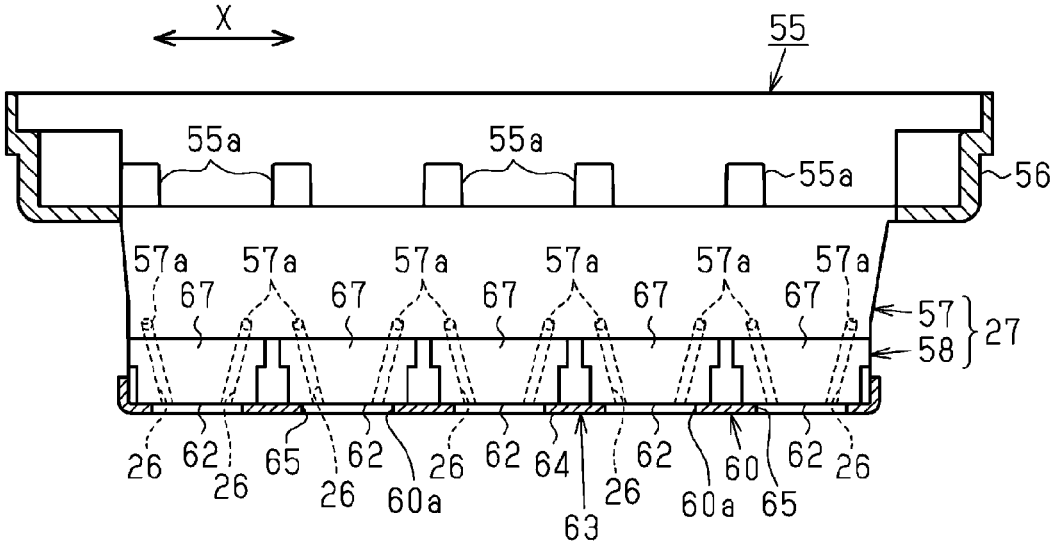
FIG. 5 is a schematic sectional view of FIG. 3.

As shown in FIGS. 4 and 5, the cover member 60 is fixed to the liquid ejecting head 27 by a fixing structure such as a lock in a state in which the cover member 60 covers a part other than the nozzle peripheral region 62 which is exposed by the through hole 60*a* on the nozzle formation surface 61. Then, as shown in FIG. 3, the entire bottom surface of the liquid ejecting head 27 is a nozzle surface 63 that is a wiping target of the wiper unit 46. The nozzle surface 63 is provided with the nozzle peripheral region 62 (that is, a region within the through hole 60*a*), and a protrusion surface 64 which is a non-nozzle region that is a region other than the nozzle peripheral region 62 and protrudes more than the nozzle peripheral region 62 by only a thickness (0.1 mm in the example) of the cover member 60.

Accordingly, a step 65 is present between the nozzle peripheral region 62 and the protrusion surface 64 (non-nozzle peripheral region). That is, the nozzle surface 63 is configured by an uneven surface which is a concave portion at a part of the nozzle peripheral region 62 and a convex portion at a part of the protrusion surface 64. Note that, the cover member 60 is configured by, for example, metal (for example, stainless steel or the like) and the like.

As shown in FIG. 4, the nozzle row 59 is formed of multiple (for example, 180 or 360) nozzles 26 which are disposed at a constant pitch along the transport direction Y. Each nozzle row 59 respectively ejects ink of one color which corresponds to the ink color of the ink cartridge 30 (refer to FIG. 1). Of course, ink of a color other than the four colors of CMYK, and white (W) may be ejected, and for example, ink of a color such as light magenta, light cyan, light yellow, gray, and orange may be ejected. In addition, the color number of the liquid ejecting head 27 may be CMYK 4 colors, CMY 3 colors, black 1 color, and the like. Furthermore, there may be unused nozzle rows which do not eject ink within the plurality of nozzle rows 59.

In addition, a liquid repelling treatment in which ink is easily repelled (ink repellent treatment) is carried out on the nozzle formation surface 61 and a liquid repellent film 66 (ink repellent film) is deposited on the front surface of the nozzle formation surface 61.

Ink which is used in the embodiment is water-based ink with water as the main solvent or non-water-based ink with organic solvent as the main solvent, and particles of multiple pigments are dispersed within solvent that is the dispersion medium. For this reason, in the example, the liquid repellent film 66 is a water repellent film having a function to repel ink. The liquid repellent film 66 may be configured from a thin film under layer that has, for example, a polyorganosiloxane containing an alkyl group as a main material and a liquid repellent film layer that is formed of a metal alkoxide that has a long-chain polymer group containing fluorine. The liquid repellent film 66 is gradually worn due to wiping with respect to the nozzle formation surface 61 being repeatedly performed, and when the liquid repellent film 66 is worn by a certain amount or more, liquid repellence is lowered. Note that, the liquid repellent film 66 may be a liquid-repellent coating film and may be a monomolecular film with liquid repellence, and it is possible to arbitrarily select the film thickness and liquid repellent treatment method thereof.

In a state in which liquid repellence of the liquid repellent film 66 is lowered, a wetting angle (contact angle) of liquid such as ink mist is reduced in the nozzle peripheral region 62. For this reason, a plurality of ink mists which are adhered in the nozzle peripheral region 62 tend to spread and one ink droplet (adhered ink) develops relatively widely. For this reason, there is a concern that such adhered ink is present in the vicinity of the nozzle 26, an opening of a part of the nozzles 26 is blocked, and furthermore, flows within the nozzle 26.

In addition, when the ink droplet is ejected from the nozzle 26 in a state in which the adhered ink is present in the vicinity of the nozzle 26, the ejected ink droplet contacts the adhered ink, and curved flight of the ink droplet is caused. Such curved flight of the ink droplet leads to lowering of printing quality caused by deviation of a landing position (that is, printing dot formation position) of the ink droplet on the recording medium 13 from an assumed position. As a result, it is necessary to suppress as much as possible wear on the liquid repellent film 66 due to wiping.

Meanwhile, the cover member 60 is manufactured such that a metal plate is processed in a predetermined shape, and liquid repellent treatment is not carried out on the front surface of the cover member 60. For this reason, the protrusion surface 64 (non-nozzle peripheral region) has a lower liquid repellence than the nozzle peripheral region 62. That is, a wetting angle of ink with respect to the protrusion surface 64 is smaller than a wetting angle of ink with respect to the nozzle peripheral region 62.

As shown in FIG. 5, the liquid ejecting head 27 has a plurality (for example five in the embodiment) of recording heads 67 (unit heads) that are arranged in parallel at a constant pitch in the scanning direction X. A peripheral edge portion of the nozzle formation surface 61 which is the lower surface of the recording head 67 is covered by the cover member 60, and the nozzle peripheral region 62 which includes two rows of nozzles 26 is exposed from the through hole 60*a* that is bored in the cover member 60.

Each nozzle 26 is linked to each ink flow path 57*a* which passes within the flow path forming portion 57, and each ink flow path 57*a* is linked to a plurality of supply pipe portions 55*a* which protrude upward from the upper surface of the flow path forming portion 57 through which a flow path that is not illustrated passes. Each supply pipe portion 55*a* is linked to a supply opening of the pressure adjustment unit 38 (refer to FIG. 1) that is mounted on the carriage 25 via the flow path that is not illustrated.

Accordingly, from each pressure adjustment unit 38 (refer to FIG. 1), ink of each corresponding color is supplied to the nozzle 26 of the corresponding recording head 67 through each supply pipe portion 55*a*, each ink flow path 57*a*, and the like. Note that, the liquid ejecting head 27 may be configured from one head which has a nozzle row of three or more rows.

Next, the flushing unit 45 will be described below with reference to FIGS. 6 to 8.

Figure 6:
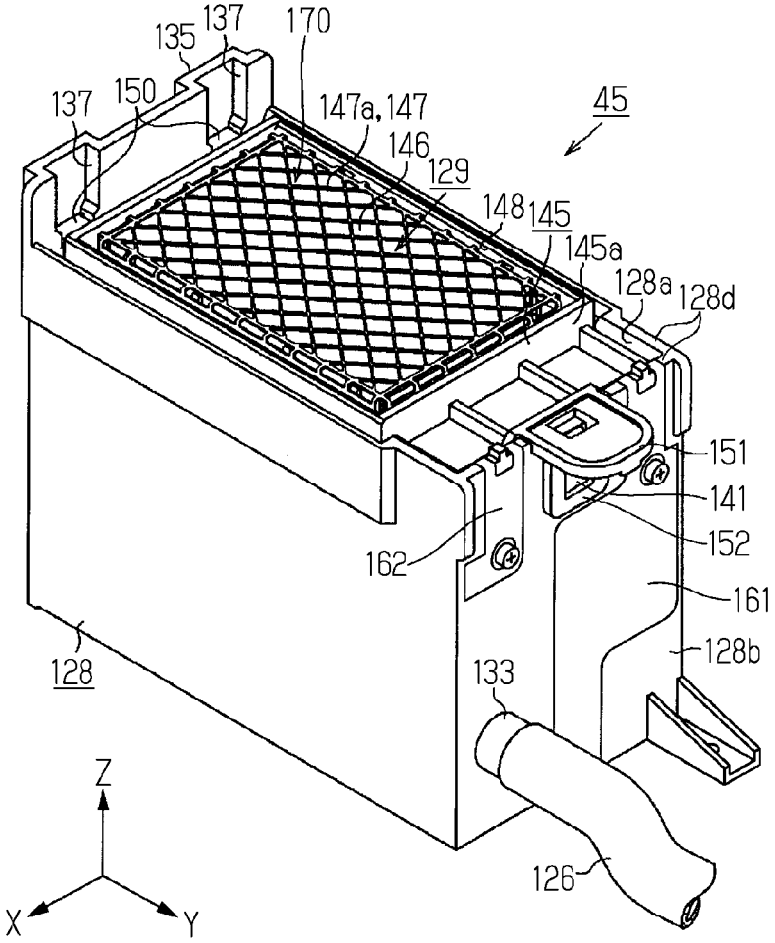
FIG. 6 is a perspective view of a flushing unit.
Figure 7:
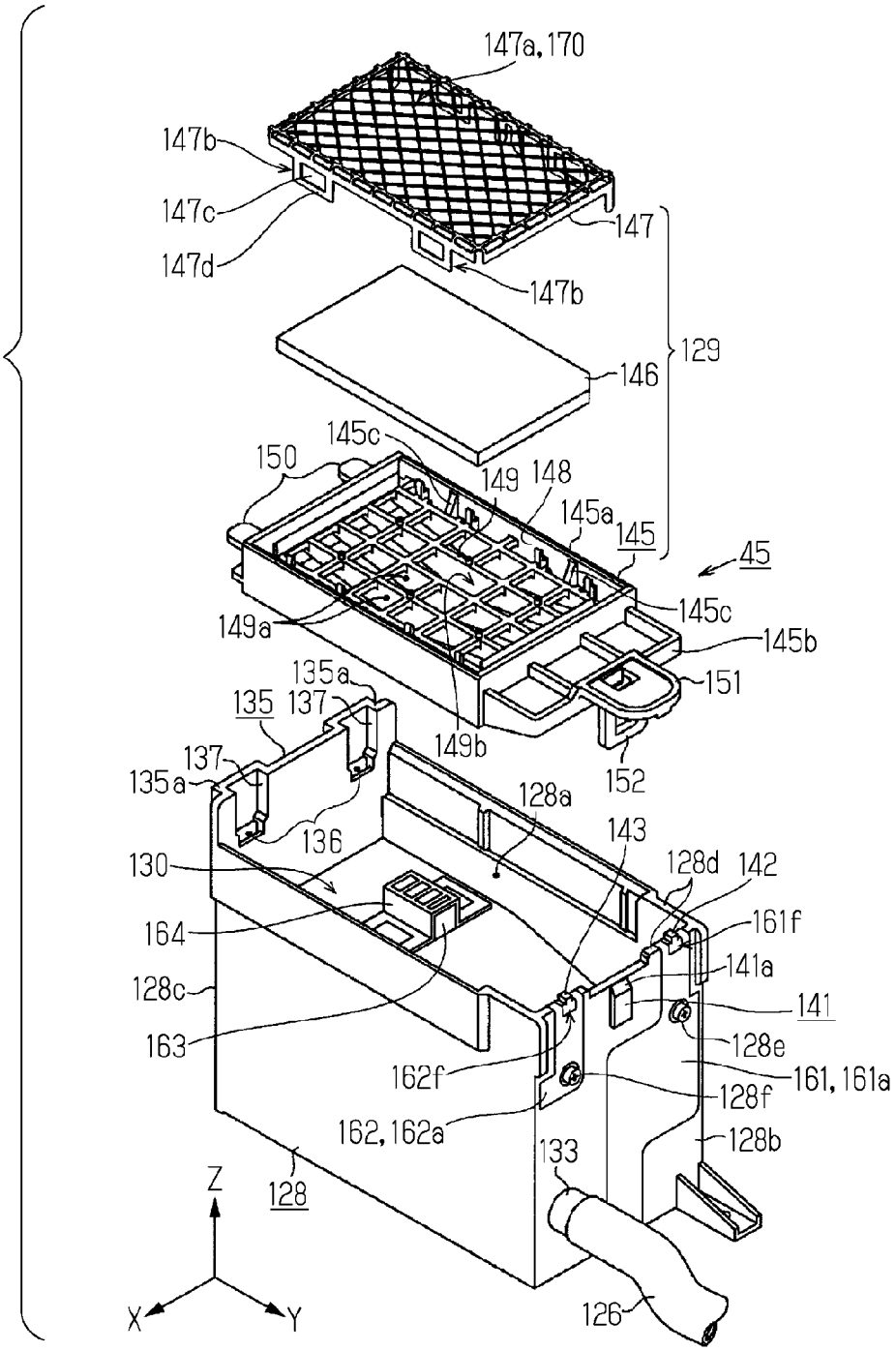
FIG. 7 is an exploded perspective view of the flushing unit.

As shown in FIGS. 6 and 7, the flushing unit 45 is provided with a chassis (flushing receptive body mounting body) 128 that has an upper orientated opening portion 128*a* in a rectangular shape that corresponds to the nozzle formation surface 61 of the liquid ejecting head 27 and with the entire shape being a rectangular cube shape, a flushing receptive body 129 that has a liquid absorption function in which the flushing unit 45 is mounted and held to be attachable and detachable with respect to the chassis 128, grounding members 161 and 162 which are attached to the chassis 128, and a second receiving member 163.

The flushing receptive body 129 is provided with the receiving member 146 that has an ink absorption function (liquid receiving function), a receiving member holding portion 145 which has a frame body portion (side wall) 145*a* with a rectangular shape that is provided so as to correspond to an opening portion 128*a* of the chassis 128 and surround the receiving member 146, and a fixing member 147 which is fixed to the receiving member holding portion 145 by contacting the receiving member 146 that is attached to the receiving member holding portion 145. For example, the receiving member 146 is formed by a porous body of melamine.

The receiving member holding portion 145 is formed of a synthetic resin material that has conductivity. For example, the receiving member holding portion 145 is formed by a polyacetal (POM) conductive grade (volume resistance value: 5×101 Ωcm, surface resistivity: 2×102Ω). As shown in FIG. 7, an accommodating concave portion 148 that is able to accommodate the receiving member 146 with a rectangular mat shape is open to the upper surface side (+Z side) and is formed on the receiving member holding portion 145. The receiving member 146 from below (−Z side) that has a lattice shape is provided on the bottom surface of the accommodating concave portion 148 by a beam member 149 which is held parallel to an XY horizontal plane so as to face the nozzle formation surface 61. The beam member 149 forms a through hole 149*b* in a center portion on the XY horizontal plane, and forms a plurality of ink dropping ports 149*a* in an opening area that is smaller than the through hole 149*b* on the periphery of the through hole 149*b*.

A pair of convex portions 150 in a short direction of the frame body portion 145*a* protrude toward one side (mounting direction side of the chassis 128) in the longitudinal direction from a side surface on one side (left side in FIG. 7) in a longitudinal direction (Y direction) of the frame body portion 145*a* in the receiving member holding portion 145. The convex portions 150 have a sectional shape which is orthogonal to a protruding direction that is a rectangular shape, and a lower surface of the convex portions 150 is formed on a tapered surface such that the thickness of the convex portions 150 becomes thinner toward a tip.

In addition, an extending portion 145*b* extends to the +Y side from the side surface of another side (right side in FIG. 7) in the longitudinal direction of the frame body portion 145*a*. The extending portion 145*b* faces a rear side wall 128*b* (described later) of the chassis 128 when the receiving member holding portion 145 is inserted and attached to the opening portion 128*a* of the chassis 128. A grasping portion 151 for grasping the receiving member holding portion 145 is formed from the extending portion 145*b* when the receiving member holding portion 145 is mounted within the opening portion 128*a* of the chassis 128. A user is able to displace the flushing receptive body 129 with an ink absorption function in which the receiving member 146 is integrally incorporated in the receiving member holding portion 145 between an oblique posture before falling and a horizontal posture during attachment and detachment with respect to the chassis 128 by grasping the grasping portion 151. In addition, a hook portion 152 that is elastically deformable in the Y direction protrudes downward from a part to which the grasping portion 151 is formed in the frame body portion 145*a*.

On the frame body portion 145*a*, locking portions 145*c* are respectively provided on an inner surface of the frame body portion 145*a* positioned on the +X side and the −X side. The locking portions 145*c* are disposed at a total of four locations two locations at a time at a gap on each surface in the Y direction. The amount of the locking portion 145*c* which protrudes inside gradually increases downward (−Z side).

The fixing member 147 is formed of a material that has conductivity. For example, the fixing member 147 is formed of a stainless steel material. As will be described later, the fixing member 147 is electrically grounded via the receiving member holding portion 145 and the grounding member 161. The fixing member 147 is formed in a substantially rectangular shape in planar view with a shape smaller than the accommodating concave portion 148 so as to be able to be accommodated in the accommodating concave portion 148 in the receiving member holding portion 145. The fixing member 147 has a mesh form portion 147*a* and a hook portion (locked portion) 147*b*. The mesh form portion 147*a* is disposed parallel to the XY horizontal plane further on the +Z side than the receiving member 146. In the flushing operation described above, the mesh form portion 147*a* forms, along with the receiving member 146, an adhesion surface 170 (refer to FIG. 6) to which ink that is ejected from the liquid ejecting head 27 is adhered.

The position of the adhesion surface 170 (mesh form portion 147*a*) in the Z direction is substantially the same as the position of an upper surface of the frame body portion 145*a* of the receiving member holding portion 145. That is, in the flushing operation, the distance between the nozzle formation surface 61 and the upper surface of the frame body portion 145*a* is substantially the same as the distance between the nozzle formation surface 61 and the adhesion surface 170. The position of the adhesion surface 170 in the Z direction is further on the −Z side than the support surface (upper surface) of the recording medium 13 by the support base 12. That is, in the flushing operation, the distance between the nozzle formation surface 61 and the adhesion surface 170 is set to be larger than the distance between the nozzle formation surface 61 and the support base 12 in ejection on the recording medium 13.

A plurality of hook portions 147*b* are provided to extend from a +X side end edge and a −X side end edge of the mesh form portion 147*a* to the −Z side. Each hook portion 147*b* is elastically deformable in the X direction, and has a hole portion 147*c* with a rectangle shape viewed from the front which is passed through in the X direction. The hole portion 147*c* is formed in a size in which it is possible to insert the locking portion 145*c* at a position at which the locking portion 145*c* of the frame body portion 145*a* is disposed. When the fixing member 147 is inserted from the +Z side to the accommodating concave portion 148 in the receiving member holding portion 145, a tip end portion 147*d* which is positioned on the −Z side (lower side) of the hole portion 147*c* is elastically deformed inside to abut with the locking portion 145*c*, and the locking portion 145*c* is inserted in the hole portion 147*c* due to elastic restoring force when riding across the locking portion 145*c*. As a result, the upper surface of the tip end portion 147*d* is locked to the lower surface of the locking portion 145*c*, and movement of the hook portion 147*b* to the +Z side is restricted. Thereby, the fixing member 147 is fixed to the receiving member holding portion 145 in a state in which the receiving member 146 is covered from the +Z side.

The chassis 128 is formed of a non-conductive material. For example, the chassis 128 is formed of PBT (polybutylene terephthalate resin). The chassis 128 has an ink receiving surface (liquid receiving surface) 130 inside which receives ink that drops down via the ink dropping port 149*a* of the receiving member holding portion 145 from the receiving member 146 in the flushing receptive body 129 that is mounted within the opening portion 128*a*. The ink receiving surface 130 is formed obliquely such that one side (left side in FIG. 7) in the longitudinal direction in the chassis 128 is further above in the direction of gravity than the other side (right side in FIG. 7).

In addition, a discharge port 133 that is connected to an upstream edge of a discharge tube 126 which is connected to the waste ink tank is formed on a lower portion of the rear side wall 128*b* in a case where the mounting direction is a front and back direction (Y direction) when the flushing receptive body 129 is mounted in the chassis 128. The discharge port 133 is formed at approximately the same height as a position near the lower side on the oblique ink receiving surface 130. That is, ink which is discharged on the receiving surface 130 is discharged to the waste ink tank via the discharge tube 126 from the discharge port 133.

A mounting wall portion 135, which has a thick wall portion 135*a* in which the thickness dimension is larger in the Y direction than a front side wall 128*c*, extends vertically upward (toward the +Z side) on an upper portion of the front side wall 128*c* in the chassis 128. The thick wall portion 135*a* in the mounting wall portion 135 is positioned separated in the short direction of the chassis 128 by a gap approximately corresponding to a gap of a pair of convex portions 150 that protrude from the frame body portion 145*a* of the receiving member holding portion 145 in the flushing receptive body 129. Then, a rectangular hole 136 with an opening shape is formed to penetrate in a part that is a boundary between the lower end portion of the thick wall portion 135*a* and the upper end portion of the front side wall 128*c* in the mounting wall portion 135 as an example of a concave portion in which the convex portion 150 on the flushing receptive body 129 side is insertable and removable in the mounting direction (Y direction) of the flushing receptive body 129.

A guidable recessed groove 137 which is formed on the thick wall portion 135*a* of the mounting wall portion 135 so as to extend along the vertical direction while the convex portion 150 on the flushing receptive body 129 side from above the hole 136 is slid in a direction toward below the hole 136. That is, the recessed groove 137 is formed so as to be linked by the lower end portion from directly above within the hole 136 in the vertical direction.

Furthermore, a locking portion 141 which is disposed in a center portion in the X direction and protruding portions 142 and 143 that are respectively disposed on both sides in the X direction that interpose the locking portion 141 are provided on an upper portion on the rear side wall 128*b* which is positioned on the +Y side in the chassis 128. The locking portion 141 is locked by elastically deforming the hook portion 152 on the flushing receptive body 129 side in the Y direction (+Y side) when the flushing receptive body 129 is mounted within the opening portion 128*a* of the chassis 128. In the locking portion 141, a sectional shape which is orthogonal to the vertical direction is formed in a rectangular shape, and an upper portion on the rear surface which is a front surface along the vertical direction is formed on a tapered surface 141*a* on which the locking portion 141 becomes thin toward the upper end.

The grounding members 161 and 162 are formed of a metal material that has conductivity. For example, the grounding members 161 and 162 are formed of stainless steel. The grounding members 161 and 162 are fixed on the rear side wall 128*b* of the chassis 128. FIG. 8 is a sectional view of a substantially center portion in the X direction in the flushing unit 45. As shown in FIGS. 7 and 8, the grounding member 161 has a fixing portion 161*a* which is fastened and fixed to a fastening member 128*e* on an outer side surface of the rear side wall 128*b*, an abutting portion 161*b* that is curved to an inside surface of the rear side wall 128*b* across the upper end portion 128*d* of the wall portion which surrounds the opening portion 128*a* that extends from the fixing portion 161*a* to the +Z side, and a grounding portion 161*c* which is curved on a rear surface (surface on the −Z side) of the chassis 128 that extends from the fixing portion 161*a* to the −Z side. The abutting portion 161*b* has a first abutting portion 161*d* along the wall surface of the rear side wall 128*b* and a second abutting portion 161*e* that is able to abut the lower surface of the extending portion 145*b* that is elastically deformed curved upward from the lower end of the first abutting portion 161*d*. The grounding member 161 has a hole portion 161*f* at a position which faces the protruding portion 142. The grounding member 161 is positionally aligned with the chassis 128 by the protruding portion 142 being inserted in the hole portion 161*f*.

The grounding member 162 has a fixing portion 162*a* which is fastened and fixed to a fastening member 128*f* on an outer side surface of the rear side wall 128*b* and an abutting portion 162*b* that is curved to an inside surface of the rear side wall 128*b* across the upper end portion 128*d* of the wall portion which surrounds the opening portion 128*a* which extends from the fixing portion 162*a* to the +Z side. Since the configuration of the abutting portion 162*b* is the same as the abutting portion 161*b*, illustration is omitted. The grounding member 162 has a hole portion 162*f* at a position which faces the protruding portion 143. The grounding member 162 is positionally aligned with the chassis 128 by the protruding portion 143 being inserted in the hole portion 162*f*.

The second receiving member 163 is held to protrude on the ink receiving surface 130 by a pressing member 164. When the flushing receptive body 129 is mounted in the chassis 128, the second receiving member 163 and the pressing member 164 which protrude from the ink receiving surface 130 are inserted in the through hole 149*b* that is formed in the beam member 149 of the receiving member holding portion 145, and are formed at a height in which the upper end portion contacts the lower surface of the receiving member 146.

Figure 8:
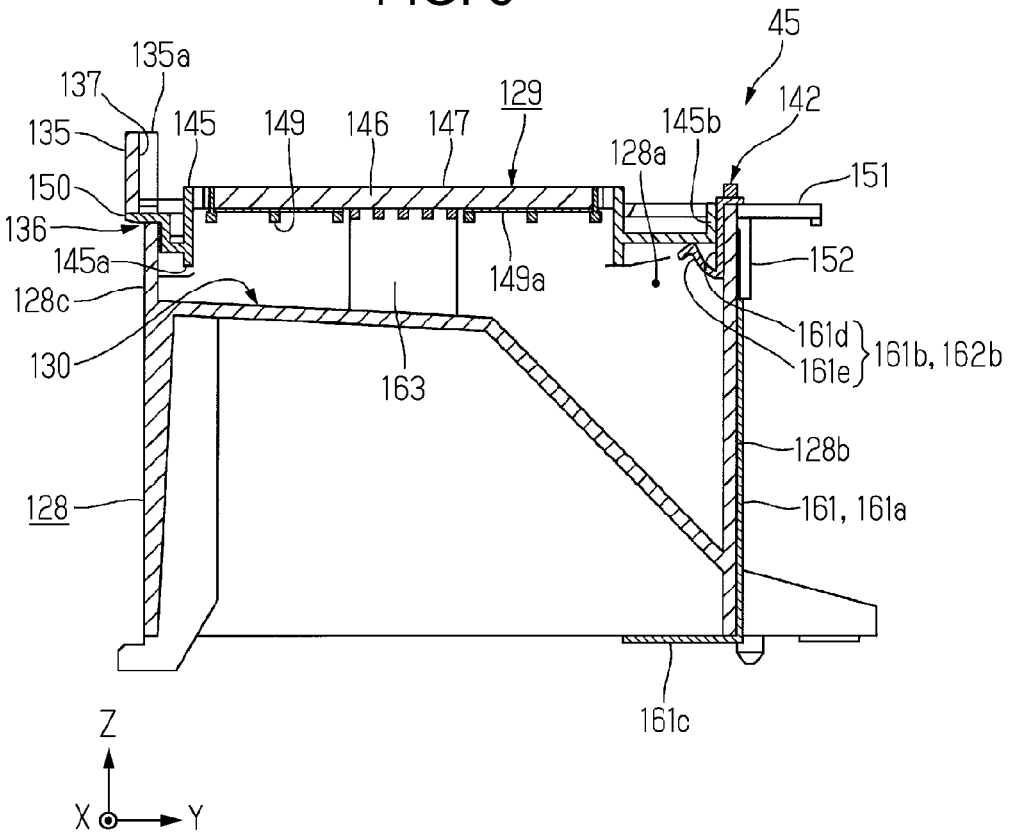
FIG. 8 is a sectional view of a substantially center portion in the X direction in the flushing unit.

When the flushing receptive body 129 inserts the convex portion 150 within the hole 136 in a state of the convex portion 150 side (−Y side) being obliquely down with respect to the grasping portion 151 side (+Y side), and is rotatably displaced with a locking part of the hole 136 and the convex portion 150 as a support point such that an oblique posture state is a horizontal posture state, as shown in FIG. 8, the hook portion 152 which hangs from a rear portion of the frame body portion 145*a* is elastically deformed to the locking portion 141 on the chassis 128 side and locked. In addition, at this time, within the hole 136, the convex portion 150 is in an engaging state of being interposed from both sides vertically by the upper side inner surface 138 and a lower side inner surface 139 of the hole 136. As a result, the flushing receptive body 129 is mounted in the chassis 128 in a state of being correctly positionally aligned in a horizontal posture within the opening portion 128*a* of the chassis 128. The upper end portion of the second receiving member 163 contacts the lower surface of the receiving member 146 by the flushing receptive body 129 being mounted within the opening portion 128*a* of the chassis 128.

When the flushing receptive body 129 is mounted in the chassis 128, an end surface on the +Y side of the extending portion 145*b* of the receiving member holding portion 145 abuts with a first abutting portion 161*d* of the grounding member 161 and a first abutting portion which is not illustrated of the grounding member 162, and the lower surface of the extending portion 145*b* abuts with the second abutting portion 161*e* of the grounding member 161 and a second abutting portion which is not illustrated of the grounding member 162. Here, since the grounding member 161 is electrically grounded in a grounding portion 161*c*, the receiving member holding portion 145 is formed of a synthetic resin material which has conductivity, and the fixing member 147 contacts the locking portion 145*c* of the receiving member holding portion 145 in the hook portion 147*b* that is formed of a metal material which has conductivity, when the flushing receptive body 129 is mounted on the chassis 128, the fixing member 147 is electrically grounded via the receiving member holding portion 145 and the grounding member 161.

Note that, since the grounding member 162 is not electrically grounded, although not contributing to electrical grounding of the fixing member 147, it is possible to stably support the flushing receptive body 129 by abutting the grounding member 161 with respect to the extending portion 145*b* of the receiving member holding portion 145. In this case, for example, the grounding member 162 may be configured to be electrically grounded by electrically connecting the grounding member 161 and the grounding member 162.

Next, the configuration of the wiper unit 46 will be described in detail.

Figure 9:
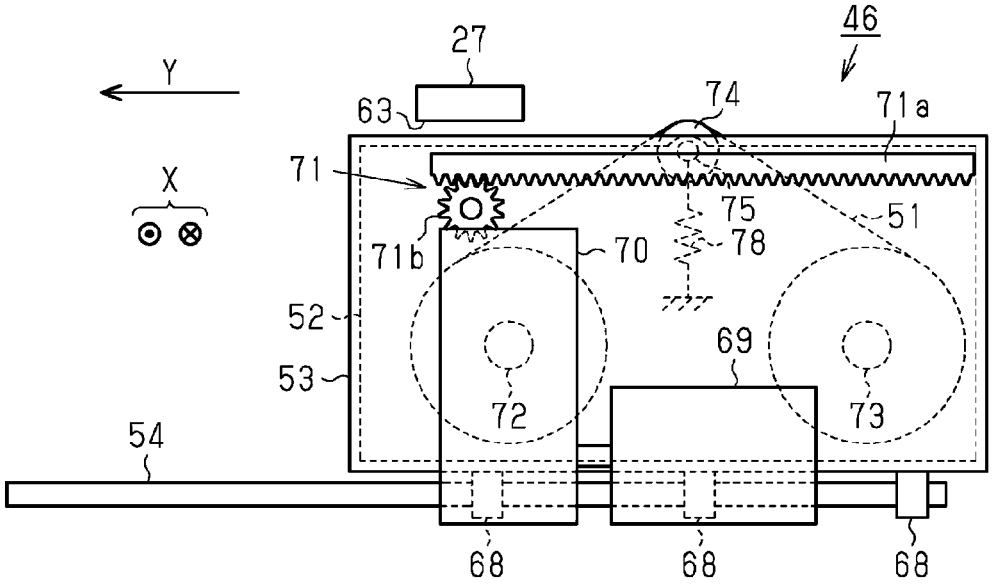
FIG. 9 is a schematic side view of a wiper unit.

As shown in FIG. 9, the wiper unit 46 is provided with the wiper cassette 52 in which a cloth sheet 51 that is able to absorb ink that is adhered to the nozzle surface 63 is mounted on the by abutting on the nozzle surface 63 of the liquid ejecting head 27 and the wiper holder 53 in which the wiper cassette 52 is mounted so as to freely attach and detach. As an example of the cloth sheet 51 of the embodiment, a cloth sheet with a thickness of 0.34 mm to 0.41 mm is adopted.

The wiper unit 46 is guided along the pair of rail portions 54 via a guide portion 68 that is fixed to the lower portion, and is able to be reciprocally moved along the transport direction Y. An electric motor 69 which is a power source and a power transmission mechanism 70 which transmits power of the electric motor 69 are provided on the printer main body 16 (refer to FIG. 1) side.

A rack and pinion mechanism 71 is provided on a side portion of the wiper unit 46. The rack and pinion mechanism 71 has a rack gear portion 71*a* that is fixed to the side surface of the wiper holder 53 at an orientation at which a longitudinal direction matches the transport direction Y and a pinion gear portion 71*b* which meshes with the rack gear portion 71*a* and rotates at the transmitted power via the power transmission mechanism 70.

Then, when the electric motor 69 is driven to rotate forward, the pinion gear portion 71*b* rotates forward and the wiper unit 46 moves forward from a retreat position shown in FIG. 9 to the downstream side (left in FIG. 9) in the transport direction Y along with the rack gear portion 71*a*. When the electric motor 69 that has stopped after forward movement is subsequently driven in reverse, the pinion gear portion 71*b* which meshes with the rack gear portion 71*a* reverses, and the wiper unit 46 moves backward to the upstream side (right in FIG. 9) in the transport direction Y and returns to the retreat position shown in FIG. 9.

A feeding shaft 72 and a winding shaft 73 are axially supported within the wiper cassette 52 in a state of being separated by a predetermined distance in the transport direction Y. The unused cloth sheet 51 is supported on the feeding shaft 72 in a state of being wound, and the cloth sheet 51 that is spent is supported on the winding shaft 73 in a state of being wound by feeding from the feeding shaft 72. Note that, cleaning liquid (for example, water and the like) is pre-impregnated in order to improve a wiping property with respect to the nozzle surface 63 in the cloth sheet 51 that is unused. Of course, the cleaning liquid may be coated before wiping the nozzle surface 63 in the cloth sheet 51 that is unused.

Figure 10:
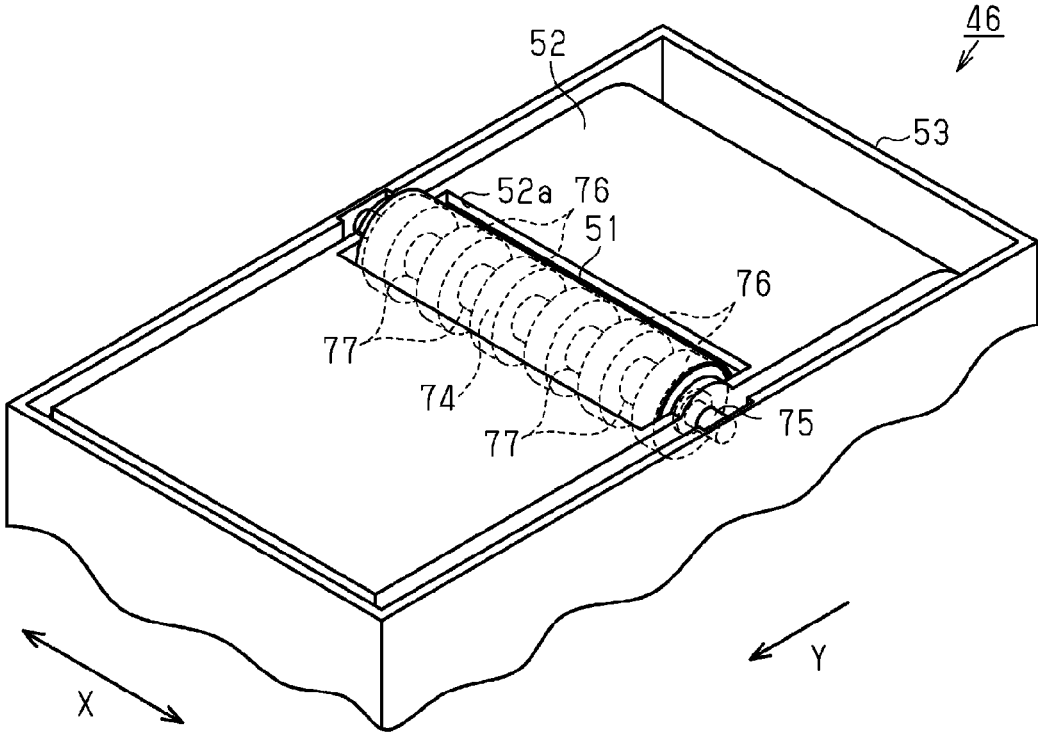
FIG. 10 is a perspective view illustrating a main portion of FIG. 9.

As shown in FIGS. 9 and 10, the cloth sheet 51 in the middle facing the winding shaft 73 by feeding from the feeding shaft 72 is wound around from the upper side on the outer peripheral surface of the pressing roller 74 as an example of the pressing portion of which a part protrudes upward from an opening portion 52*a* of a rectangular shape that is formed in an upper surface center portion of the wiper cassette 52.

The pressing roller 74 is provided with a support shaft 75 with a round bar shape, a plurality (six in the embodiment) of large diameter portions 76 with an annular form as an example of the convex portion that is formed so as to be equally spaced in an axis line direction on the peripheral surface of the support shaft 75, and a plurality (five in the embodiment) small diameter portions 77 with an annular form with a smaller outer diameter than the large diameter portion 76 that is formed between the large diameter portions 76 on the peripheral surface of the support shaft 75. Accordingly, the peripheral surface of the pressing roller 74 is configured by an uneven surface that forms a step. In this case, a difference (step difference of the peripheral surface of the pressing roller 74) of height from the peripheral surface of the support shaft 75 of each large diameter portion 76 and each small diameter portion 77 is set to 0.6 mm±0.1 mm in the embodiment.

For example, the support shaft 75 is configured by a hard material such as a metal or hard synthetic resin, and for example, each large diameter portion 76 and each small diameter portion 77 are configured by an elastic material such as rubber. Each large diameter portion 76 and each small diameter portion 77 are disposed alternately without a gap in the axis line direction of the support shaft 75, and are integrally formed. Then, in the support shaft 75, the pressing roller 74 is biased upward by a spring 78, and each large diameter portion 76 of the pressing roller 74 is in a state of pressing the cloth sheet 51 upward.

Accordingly, the pressing roller 74 is able to cause the cloth sheet 51 to contact the nozzle surface 63 by pressing the cloth sheet 51 from the opposite side to the side that contacts the nozzle surface 63 on the cloth sheet 51. In addition, the width of the cloth sheet 51 in the scanning direction X (axis line direction of the support shaft 75) is slightly wider the width of the nozzle surface 63 of the liquid ejecting head 27 in the scanning direction X. For this reason, it is possible to wipe the entirety of the nozzle surface 63 using the cloth sheet 51. Then, it is possible to adopt a material that is able to absorb and hold liquid (ink and cleaning liquid) with a weight ratio of 350% in the cloth sheet 51 of the embodiment. It is preferable that the cloth sheet 51 and the pressing roller 74 are electrically grounded since the cloth sheet 51 and the pressing roller 74 contact the nozzle formation surface 61.

In addition, in a state in which the wiper unit 46 is at a forward movement end position, for example, power transmission to the pinion gear portion 71*b* using a clutch mechanism (illustration omitted) within the power transmission mechanism 70 is blocked, and the winding shaft 73 is connected to the power transmission mechanism 70 to be able to transfer power. In this state, the winding shaft 73 rotates, the cloth sheet 51 that is unused is fed from the feeding shaft 72 and the cloth sheet 51 that is spent is wound by the winding shaft 73 due to power that is transmitted from the electric motor 69 via the power transmission mechanism 70.

At this time, the carriage 25 (refer to FIG. 2) retreats from the position at which the nozzle surface 63 of the liquid ejecting head 27 is wiped by the wiper unit 46. Then, after the wiping operation by the wiper unit 46 ends, when the electric motor 69 drives in reverse, the wiper unit 46 moves backward, and returns to the retreat position shown in FIG. 9.

Figure 11:
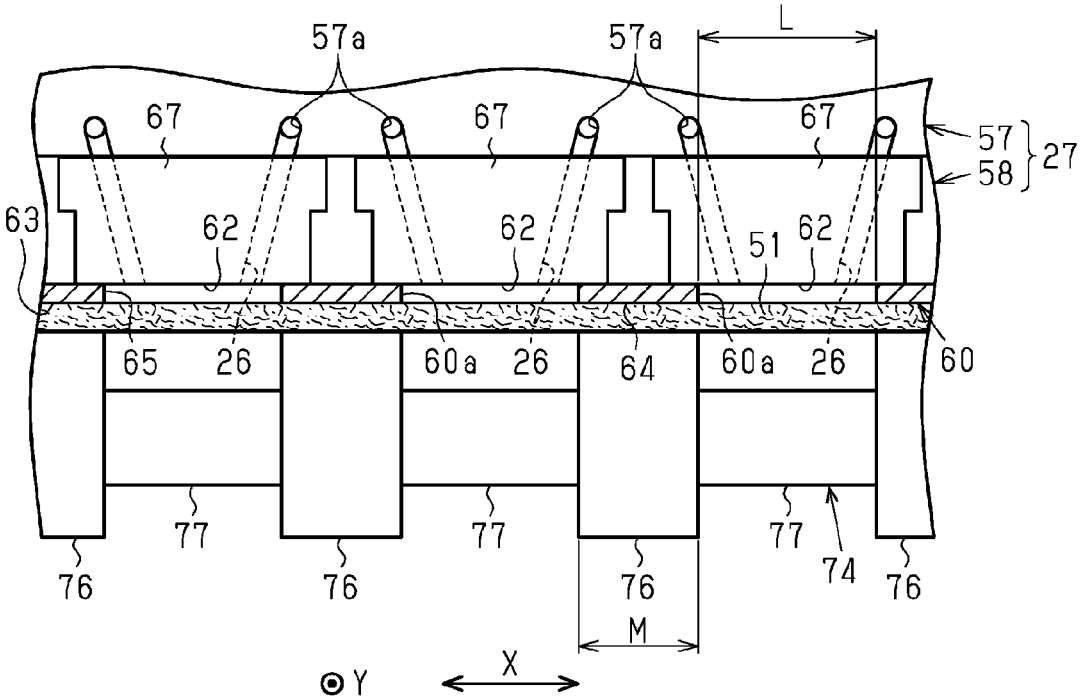
FIG. 11 is a schematic sectional view illustrating a second contact operation.

As shown in FIG. 11, a dimension M of the large diameter portion 76 in a direction that intersects with the direction which moves relatively to the liquid ejecting head 27 in a direction along the nozzle surface 63 in a state in which the cloth sheet 51 contacts the nozzle surface 63 is shorter than a dimension L of the nozzle peripheral region 62 in the intersection direction. That is, the dimension M of the large diameter portion 76 in the scanning direction X that is a direction that is orthogonal to the transport direction Y that is the movement direction when the cloth sheet 51 wipes the nozzle surface 63 is shorter than a dimension L of the nozzle peripheral region 62 in the scanning direction X.

In this case, it is preferable that the dimension L of the nozzle peripheral region 62 in the scanning direction X is slightly longer than the sum of a dimension of the large diameter portion 76 in the scanning direction X and a dimension that is equivalent to two times the thickness of the cloth sheet 51. In addition, the dimension L of the nozzle peripheral region 62 in the scanning direction X, the dimension of the through hole 60*a* in the scanning direction X, and the dimension of the small diameter portion 77 of the pressing roller 74 in the scanning direction X are the same. In the embodiment, the dimension L of the nozzle peripheral region 62 in the scanning direction X is set to 6.58 mm.

Furthermore, a dimension of a part that is interposed by each nozzle peripheral region 62 in the scanning direction X of the cover member 60, that is, a gap between each nozzle peripheral region 62 in the scanning direction X is the same as the dimension M of the large diameter portion 76 in the scanning direction X. Accordingly, six large diameter portions 76 in the pressing roller 74 are arranged in the scanning direction X such that the gap of the dimension L of the nozzle peripheral region 62 in the scanning direction X is open, and five nozzle peripheral regions 62 are arranged in the scanning direction X such that the gap by the dimension M of the large diameter portion 76 in the scanning direction X is open.

According to this configuration, a part that is wound around the large diameter portion 76 of the pressing roller 74 in the cloth sheet 51 is able to selectively press (cause to contact) with respect to the nozzle peripheral region 62 and the protrusion surface 64 (non-nozzle peripheral region) on the nozzle surface 63 by adjusting the position in the scanning direction X of the nozzle surface 63 and the large diameter portion 76 of the pressing roller 74 by moving the liquid ejecting head 27 side in the scanning direction X.

Figure 14:
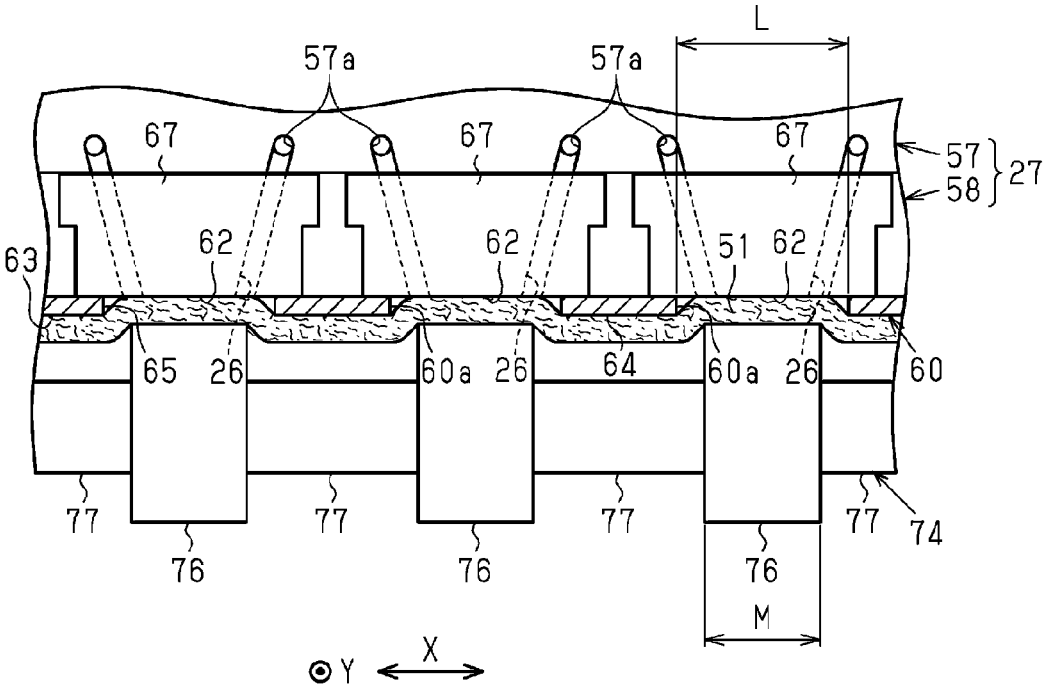
FIG. 14 is a schematic sectional view illustrating a first contact operation.

In this case, as shown in FIG. 14, the operation in which the cloth sheet 51 which is pressed by the large diameter portion 76 of the pressing roller 74 is caused to contact the nozzle surface 63 at a position which corresponds to the nozzle peripheral region 62 on the nozzle surface 63 is a first contact operation. Meanwhile, as shown in FIG. 11, the operation in which the cloth sheet 51 which is pressed by the large diameter portion 76 of the pressing roller 74 is caused to contact the nozzle surface 63 at a position which corresponds to the non-nozzle peripheral region (protrusion surface 64) that is a region outside of the nozzle peripheral region 62 on the nozzle surface 63 is a second contact operation.

Next, an action of the ink jet printer 11 will be described. For example, the printer 11 which is applied in the embodiment performs recording of an image on the recording medium using non-water-based ink. In the invention, "non-water-based ink" is ink in which the organic solvent is set as the main solvent and water is not set as the main solvent. Preferably, content of water within ink is 3 mass %, more preferably 1 mass %, further preferably less than 0.05 mass %, even more preferably less than 0.01 mass %, furthermore preferably less than 0.005 mass %, and is most preferably less than 0.001 mass %. Alternatively, ink may not substantially contain water. "Not substantially contain" designates not intentionally containing. In a case of the non-water-based ink composition including another component other than solvent such a color material or resin, it is possible that the content of organic solvent within the non-water-based ink is a residual amount of the rest with the other component removed, for example, 70 mass % or more, and furthermore 80 mass % or more are possible, and for the upper limit of the content, 100 mass % or less, and furthermore 99 mass % or less are possible.

Since the non-water-based ink has organic solvent as the main solvent, although it is advantageous in that water resistance is superior and a drying property is superior when the non-water-based ink adheres to the recording medium with the low-adsorption property, there is a problem in that the non-water-based ink tends to adhere to the nozzle formation surface and removal tends to be difficult. (The problem is solved by the configuration of the wiper unit 46) in addition, in a case where conductivity is low in comparison to water-based ink and ink is charged, there is a problem in that discharge by water-based ink tends not to occur. The problem is solved by carrying out cleaning in consideration of grounding of the flushing receptive body 129 and a discharge property of the medium.

Components included in the non-water-based ink and components that are able to be included are described below in detail.

Organic Solvent

In the non-water-based ink, it is preferable to contain a glycol ether as the organic solvent. The glycol ether is able to control wettability and a penetration rate with respect to the recording medium and suppress irregularities and the like of the recorded image.

For example, as the glycol ether, alkylene glycol monoether, alkylene glycol diether, and the like are given. It is possible to use one type alone or two or more types of glycol ether mixed.

As the alkylene glycol monoether, for example, ethylene glycol monomethyl ether, ethylene glycol monoethyl ether, ethylene glycol mono-isopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, dipropylene glycol monomethyl ether, dipropylene glycol mono ethyl ether, and the like are given.

As the alkylene glycol ether, for example, ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and the like are given.

The lower limit value of content of the glycol ether that is included in the non-water-based ink is preferably 10 mass % or more, is more preferably 20 mass % or more, and is even more preferably 30 mass % or more with respect to total mass (100 mass %) of non-water-based ink. In addition, the upper limit value is preferably 95 mass % or less, more preferably 90 mass % or less, further preferably 85 mass % or less, furthermore preferably 80 mass % or less, and particularly preferably 75 mass % or less. It is possible to improve spreading of the liquid droplet and form a favorable image with superior smoothness by setting the content to 20 mass % or more. In addition, there are cases where it is possible to suppress cohesion irregularities due to excessive spread of wetting by setting the content of the glycol ether solvent to 95 mass % or less.

In the non-water-based ink in the embodiment, it is preferable to contain lactone as the organic solvent. It is possible for the lactone to increase adhesiveness of the non-water-based ink with respect to the recording medium by dissolving a portion of the recording surface (preferably the recording surface which includes vinyl chloride resin) and infiltrating the non-water-based ink inside the recording medium. "Lactone" in the invention collectively refers to a ring compound which has ester (—CO—O—) in the ring. The lactone is not particularly limited as long as lactone is included in the definition, but a lactone with a carbon number of 2 to 9 is preferable. As a specific example of the lactone, α-ethyl lactone, α-acetoacetic lactone, β-propiolactone, γ-butyrolactone, δ-valerolactone, ϵ-caprolactone, ζ-henin thiolactone, η-capri butyrolactone, γ-valerolactone, γ-heptalactone, γ-nonalactone, β-methyl-δ-valerolactone, 2-butyl-2-ethyl-propiolactone, α, α-diethylpropiolactone and the like are given, but thereamong, γ-butyrolactone is particularly preferable. In the exemplified lactone, one type alone may be used or two or more types may be mixed and used.

In a case where lactone is contained, the content thereof is preferably 5 mass % or more and is more preferably 10 mass % or more with respect to total mass of the non-water-based ink. There is a tendency for scratch resistance of the image to be further improved by the content of the lactone being 5 mass % or more. The content is preferably 75 mass % or less, is more preferably 40 mass % or less, and furthermore preferably 30 mass % or less. There is a tendency for glossiness of the image to be improved by the content being 75 mass % or less.

Other Organic Solvent

As another organic solvent, the non-water-based ink may contain an ester, a hydrocarbon, and an alcohol in addition to or in place of the organic solvent described above. As the ester, methyl acetate, ethyl acetate, n-propyl, isopropyl acetate, n-butyl, isobutyl acetate, isopentyl acetate, acetate secondary butyl, amyl acetate, methoxybutyl acetate, methyl lactate, ethyl lactate, butyl lactate, methyl caprylate, ethylene glycol monomethyl ether acetate, ethylene glycol monoethyl ether acetate, propylene glycol monomethyl ether acetate, propylene glycol monoethyl ether acetate, diethylene glycol monomethyl ether acetate, diethylene glycol monoethyl ether acetate, diethylene glycol monobutyl ether acetate, and the like are given.

As the hydrocarbon, an aliphatic hydrocarbon (for example, paraffin or isoparaffin), an alicyclic hydrocarbon (for example, cyclohexane, cyclooctane, cyclodecane, and the like), an aromatic hydrocarbon (for example, benzene, toluene, xylene, naphthalene, tetralin, and the like), and the like are given. As the hydrocarbon, a commercial product may be used, and an aliphatic hydrocarbon solvent or alicyclic hydrocarbon solvent such as IP Solvent 1016, IP Solvent 1620, IP clean LX (all product names of Idemitsu Kosan Co., Ltd.), Isopar G, Isopar L, Isopar H, Isopar M, Exxsol D40, Exxsol D80, Exxsol D100, Exxsol D130, Exxsol D140 (all product names of Exxon Corp.), NS Clean 100, NS Clean 110, NS Clean 200, NS Clean 220 (all product names of JX Nippon Oil & Energy Co.), Naphtesol 160, Naphtesol 200, Naphtesol 220 (all product names of JX Nippon Oil & Energy Co.), and an aromatic hydrocarbon solvent such as Solvesso 200 (product name of Exxon Corp.) are given.

As the alcohol, for example, methanol, ethanol, isopropanol, 1-propanol, 1-butanol, 2-butanol, 3-pentanol, 2-methyl-1-butanol, 2-methyl-2-butanol, isoamyl alcohol, 3-methyl-2-butanol, 3-methoxy-3-methyl-1-butanol, 4-methyl-2-pentanol, allyl alcohol, 1-hexanol, 1-heptanol, 2-heptanol, 3-heptanol, and the like are given. The organic solvents other than described above may be one or two or more, and the content of one or more is preferably 10 mass % or more, more preferably 30 mass % or more, furthermore preferably 50 mass % or more, preferably 90 mass % or less, and more preferably 80 mass % or less with respect to total mass of the non-water-based ink.

Resin

In the non-water-based ink used in the embodiment, it is preferable to contain resin. As the resin, a resin which protects the image that is obtained using the non-water-based ink by forming a film, a resin for improving adhesiveness of an ink coating film of the image, a resin for adjusting glossiness of the ink coating film of the image, and in addition a resin for improving the quality of the ink coating film of the image are given. Therein, it is preferable that resin which has at least a function of forming the film and protecting the image obtained using the non-water-based ink has friction-fastness of the recorded material and the like, and the embodiment of the invention particularly acts. There are times when the resin is referred to as a fixing resin.

As the resin, for example, various synthetic rubbers such as (meth) acrylic resin (for example, poly (meth) acrylic acid, poly (meth) acrylate, poly (meth) acrylate, (meth) acrylic acid-(meth) acrylic acid ester copolymer resin, styrene-(meth) acrylic copolymer resin, ethylene-(meth) acrylic acid copolymer resin, ethylene-alkyl (meth) acrylate resin, ethylene-(meth) acrylic acid ester copolymer resin, and the like), vinyl chloride resin (for example, polychlorinated vinyl, vinyl chloride-vinyl acetate copolymer resin, and the like), aliphatic polyester, aromatic polyester, polyurethane, epoxy resin, polyvinyl acetate, ethylene-vinyl acetate copolymer resin, polycarbonate, polyvinyl butyral, polyvinyl alcohol, phenoxy resin, ethylcellulose resin, cellulose acetate propionate resin, cellulose acetate butyrate, nitrocellulose resin, polystyrene, vinyl toluene-α-methyl styrene copolymer resin, polyamide, polyimide, polysulfone resin, petroleum resin, chlorinated polypropylene, polyolefin, terpene resin, rosin-modified phenolic resin, NBR•SBR•MBR, modified products thereof, and the like are given. In the resin, one type alone may be used or two or more types may be mixed and used.

Within the resin described above, from the viewpoint of further improving scratch resistance of the image, it is preferable to use at least one of (meth) acrylic resin and vinyl chloride resin. The (meth) acrylic resin includes at least one of (meth) acrylate and (meth) acrylic acid as a monomer component that is used during resin synthesis, and the vinyl chloride resin includes at least vinyl chloride as the monomer component that is used during resin synthesis.

As the (meth) acrylic resin, a commercial product may be used, and for example, ACRYPET MF (product name, manufactured by Mitsubishi Rayon Co., Ltd., acrylic resin), SUMIPEX LG (product name, manufactured by Sumitomo Chemical Co., Ltd., acrylic resin), PARALOID B-series (product name, Rohm and Haas Co., acrylic resin), parapet G-1000P (product name, manufactured by Kuraray Co., Ltd., acrylic resin), and the like may be given. Note that, in the invention, (meth) acrylic acid has the meaning of both acrylic acid and methacrylic acid, and (meth) acrylate has the meaning of both acrylate and methacrylate.

As the vinyl chloride resin, a commercial product may be used, and for example, Kanevinyl S-400, HM515 (product name, manufactured by Kaneka Corporation), SOLBIN C (product name, Nissin Chemical Co., Ltd.), and the like are given.

Any type of resin may be used such as a solid form, solution form, or emulsion state in the resin that is included in the non-water-based ink, and it is preferable to use a solution which is dissolved in ink (resin which is dissolved in ink).

The content in the solid content of the resin is preferably 0.5 mass % to 10 mass %, is more preferably 0.5 mass % to 6 mass %, and is furthermore preferably 0.5 mass % to 5 mass % with respect to total mass of non-water-based ink. There is a tendency for scratch resistance of the image to be further improved by the content of the resin being 0.5 mass % or more. In addition, it is possible to easily set the viscosity of the non-water-based ink in a range that is appropriate in ink jet recording by setting the content of resin to 10 mass % or less.

Color Material

The non-water-based ink according to the embodiment may contain a color material. As the color material, a dye may be used, and it is also possible to use a pigment such as an inorganic pigment or an organic pigment, but it is preferable to use a pigment from the viewpoint of light resistance and the like. In the color material, one type alone may be used or two or more types may be mixed and used.

As the organic pigment, for example, azo pigment (for example, azo lake, insoluble azo pigment, condensed azo pigment, chelate azo pigment, and the like), polycyclic pigment (phthalocyanine pigment, perylene and perylene pigment, anthraquinone pigment, quinacridone pigment, dioxazine pigment, thioindigo pigment, isoindolinone pigment, quinophthalone pigment, and the like), dye lake (for example, basic dye lake, acidic dye lake, and the like), nitro pigment, nitroso pigment, aniline black, daylight fluorescent pigment, and the like are given. In addition, as the inorganic pigment, carbon black, titanium dioxide, silica, alumina, and the like are given.

The content of the color material is able to be appropriately set as desired, is not particularly limited, but ordinarily is 0.1 mass % to 10 mass % with respect to total mass of non-water-based ink.

In addition, in a case where pigment is used as the color material, a pigment dispersant may be contained, and for example, a polyester polymer compound such as Hinoakuto KF1-M, T-6000, T-7000, T-8000, T-8350P, T-8000E (all manufactured by Takefu Fine Chemicals Co., Ltd.), Solsperse 20000, 24000, 32000, 32500, 33500, 34000, 35200, 37500 (all manufactured Lubrizol Corp.), Disperbyk-161, 162, 163, 164, 166, 180, 190, 191, 192, 2091, 2095 (all manufactured by BYK Japan KK), Flowlen DOPA-17, 22, 33, G-700 (all manufactured by Kyoeisha Chemical Co., Ltd.), Ajisper PB821, PB711 (both manufactured by Ajinomoto Co., Inc.), LP4010, LP4050, LP4055, POLYMER 400, 401, 402, 403, 450, 451, 453 (all manufactured by EFKA Chemicals Co., Ltd.), and the like are given. It is possible to appropriately select the content in a case where the pigment dispersant is used according to the contained pigment, but preferably the content is 5 parts by mass to 200 parts by mass and more preferably 30 parts by mass to 120 parts by mass with respect to content of 100 parts by mass of pigment within the non-water-based ink.

Other Components

The non-water-based ink according to the embodiment is able to contain a substance for a imparting a predetermined performance such as surfactant (for example, silicon surfactant, acetylene glycol surfactant, fluorine surfactant, and the like), a pH regulator, a chelator such as ethylenediamine tetraacetate (EDTA), a preservative and an antifungal agent, and an anti-corrosion agent.

Non-Water-Based Ink Preparative Method

In the non-water-based ink according to the embodiment, the components described above are mixed in an arbitrary order, and according to necessity, the non-water-based ink is obtained by removing impurities by filtering and the like. As a mixing method of each component, a method is appropriately used in which material is sequentially added to a vessel, which is provided with a stirring device such as a mechanical stirrer and a magnetic stirrer, and stirred and mixed. As a filtration method, it is possible to perform centrifugal filtration, filtration with a filter, and the like according to necessity.

Non-Water-Based Ink Properties

In the non-water-based ink according to the embodiment, preferably surface tension at 20° C. is 20 mN/m to 50 mN/m and more preferably 25 mN/m to 40 mN/m from the viewpoint of balance of recording quality and reliability as ink for ink jet recording. Note that, measurement of surface tension uses an automatic surface tension meter CBVP-Z (manufactured by Kyowa Interface Science Co., Ltd.), and it is possible to measure by confirming surface tension when a platinum plate is wetted by ink under an environment of 20° C.

In addition, from the same viewpoint, viscosity of non-water-based ink at 20° C. is preferably 2 mPa·s to 15 mPa·s, and is more preferably 2 mPa·s to 10 mPa·s. Note that, measurement of viscosity uses a viscoelasticity testing machine MCR-300 (manufactured by Pysica), and it is possible to raise a shear rate from 10 to 1000 and measure viscosity by reading at the shear rate of 200 under an environment of 20° C.

In the ink jet printer 11, printing on the recording medium 13 proceeds due to a printing operation in which recording by one scan is carried out on the ink adhesion surface of the recording medium 13 by ejecting the ink droplet from each nozzle 26 of the liquid ejecting head 27 in the middle of movement of the carriage 25 in the scanning direction X and a transport operation in which the recording medium 13 is transported up to a subsequent printing position being alternately repeated. During printing, the wiper unit 46 is in standby at the retreat position which is shown in FIG. 9. In addition, in the printer 11, an operation is carried out in which printing is performed by performing a plurality of times an operation in which ink is ejected with respect to the same scanning region as the ink adhesion surface of the recording medium 13 while scanning the liquid ejecting head 27.

As the recording medium 13 which is used in printing, it is possible to use a resin film such as other paper, PVC, and tarpaulin (the surface is material in which fiber fabric (polyester, cotton, and the like) is superimposed in a sandwiched state and pasted together using a synthetic resin film (soft polyvinyl chloride, polyurethane, EVA, and the like)). As such a resin film, there is a material in which it is difficult to discharge ink that is ejected at a high surface resistance value and a material that is easily charged (film, tarpaulin) in a transport process.

Capping Operation and Wiping Operation

In the ink jet printer 11, at a predetermined timing (during replacement of the ink cartridge 30, during generation of an ejection defect of ink from the nozzle 26, prior to printing, and the like), ink within the liquid ejecting head 27 is discharged from the nozzle 26 by forcibly suctioning and head cleaning is performed in the maintenance operation. In a case where head cleaning is performed, first, after the carriage 25 and the liquid ejecting head 27 are moved to the home position HP at which the capping unit 48 is disposed due to driving of the carriage motor 24, the liquid ejecting head 27 is subjected to capping by the cap portion 47 by raising the cap portion 47 by driving the capping motor 49.

Next, when the inside of the cap portion 47 (closed space) is adsorbed by driving the suction pump 50, thickening of ink, air bubbles, and the like within the liquid ejecting head 27 are discharged from each nozzle 26 within the cap portion 47. At this time, since the inside of the cap portion 47 is in a state in which ink that is discharged from each nozzle 26 is filled, ink soaks into a region which corresponds to the inside of the cap portion 47 on the nozzle surface 63.

Then, when ink of a predetermined amount is discharged from each nozzle 26, the suction pump 50 is stopped. Next, when an air releasing valve (illustration omitted) which is provided in the cap portion 47 is open, air is released within the cap portion 47. Next, when the cap portion 47 is lowered by driving of the capping motor 49, the cap portion 47 is separated from the liquid ejecting head 27.

After that, ink which is residual within the cap portion 47 is discharged by the suction pump 50 being driven for a predetermined time and air suction being performed within the cap portion 47. Thereby, head cleaning is complete. After head cleaning is completed, since a region which corresponds to inside the cap portion 47 on the nozzle surface 63 is in a state of being wetted with ink, it is necessary to wipe the nozzle surface 63 that is to remove the ink using the wiper unit 46.

In this case, since the nozzle formation surface 61, that is, the nozzle peripheral region 62 is covered by the liquid repellent film 66, a small ink droplet (smaller ink droplet than the step 65 of 0.1 mm) that is adhered to the nozzle peripheral region 62 flows when the cap portion 47 is separated from the liquid ejecting head 27. For this reason, a state remains in which a large ink droplet (larger ink droplet than the step 65 of 0.1 mm) is adhered to the nozzle peripheral region 62.

Then, in a case where wiping of the nozzle surface 63 is performed by the wiper unit 46, first, the carriage 25 is moved to a position at which the nozzle surface 63 of the liquid ejecting head 27 is wiped using the wiper unit 46 by driving of the carriage motor 24. In this case, the carriage 25 is moved to a position at which contact with the cloth sheet 51 is possible by the second contact operation in which the cloth sheet 51 that is pressed by the large diameter portion 76 of the pressing roller 74 is caused to contact the nozzle surface 63 at a position which corresponds to the non-nozzle peripheral region (protrusion surface 64) that is a region outside of the nozzle peripheral region 62 on the nozzle surface 63.

Figure 12:
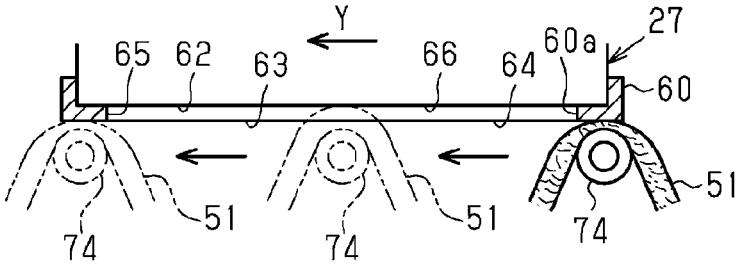
FIG. 12 is a schematic side-surface view illustrating a state when the nozzle surface is wiped.
Figure 13:
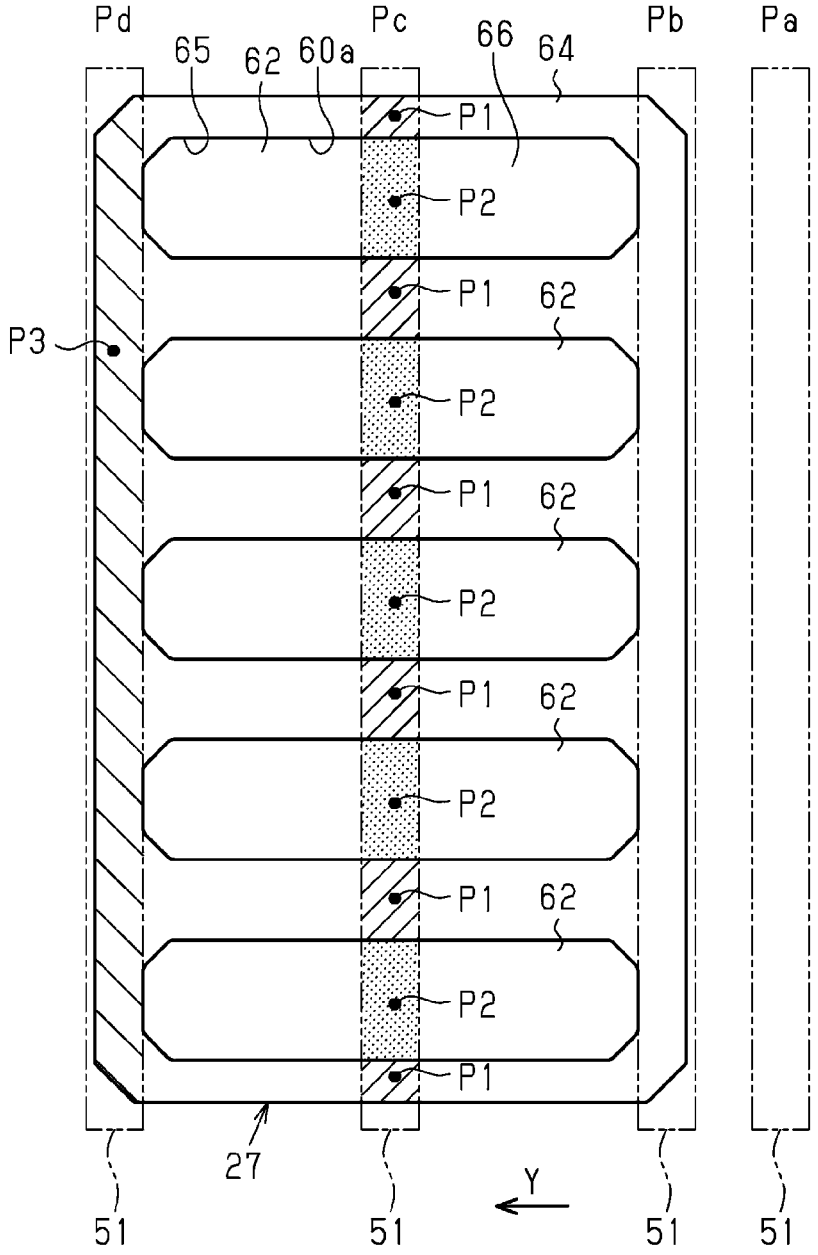
FIG. 13 is a schematic view illustrating a state when the nozzle surface is wiped viewed from a nozzle surface side.

Next, as shown in FIGS. 12 and 13, when the wiper unit 46 is caused to move forward from the retreat position in the transport direction Y, the entirety of the nozzle surface 63 is wiped by moving the cloth sheet 51 in order of a Pa position, a Pb position, a Pc position, and a Pd position. At this time, since the part that is pressed on the large diameter portion 76 of the pressing roller 74 of the cloth sheet 51 is pressed at a relatively large pressure on the protrusion surface 64, adhered ink on the protrusion surface 64 is adsorbed to the cloth sheet 51, and is substantially reliably wiped away.

At this time, since a load on the pressing roller 74 is 3.43 N, and a contact area is 132.8 $mm^2$ when the pressing roller 74 elastically changes shape and contacts the cloth sheet 51, pressure is 25.8 kPa when the pressing roller 74 presses the cloth sheet 51 on the protrusion surface 64. Furthermore, at this time, since an amount of compression of the cloth sheet 51 is 0.07 mm to 0.08 mm when the cloth sheet 51 with a thickness of 0.34 mm to 0.41 mm is pressed on the protrusion surface 64 by the pressing roller 74, the thickness is 0.26 mm to 0.34 mm when the cloth sheet 51 wipes the protrusion surface 64.

Furthermore, at this time, as shown in FIG. 11, in the pressing roller 74, the part that corresponds to the through hole 60*a* is the small diameter portion 77, a part which corresponds to the nozzle peripheral region 62 of the cloth sheet 51 is barely pressed by the pressing roller 74, and the pressing roller 74 avoids pressing within the through hole 60*a* with a strong pressing force.

As a result, the part which corresponds to the through hole 60*a* in the cloth sheet 51 contacts the nozzle peripheral region 62 at smaller pressure than pressure (wiping pressure) at which the part that corresponds to the protrusion surface 64 in the cloth sheet 51 contacts the protrusion surface 64. That is, in the contact of the cloth sheet 51 by the second contact operation, the pressing force which is applied to the nozzle peripheral region 62 due to contact with the cloth sheet 51 is smaller than pressing force which is applied to the protrusion surface 64 (non-nozzle peripheral region) due to contact with the cloth sheet 51.

At this time, compressibility of the part that is pressed on the nozzle peripheral region 62 on the cloth sheet 51 is smaller than compressibility of the part that is pressed on the protrusion surface 64 (non-nozzle peripheral region) on the cloth sheet 51. Then, adhered ink on the nozzle surface 63 is absorbed to the cloth sheet 51 and wiped away by moving in the transport direction Y that is the wiping direction in a state in which the cloth sheet 51 contacts at pressures P1 and P2 that are shown at position Pc in FIG. 13.

Flushing Operation

Next, a flushing operation in which ink is ejected from the liquid ejecting head 27 described above on the flushing unit 45 will be described. Ink which is flushed from the liquid ejecting head 27 is adhered to the adhesion surface 170 that is formed by the mesh form portion 147*a* of the receiving member 146 or the fixing member 147, and is infiltrated and absorbed inside the receiving member 146. Note that, when ink which is adhered to the mesh form portion 147*a* is not able to be held in the mesh form portion 147*a*, the ink is infiltrated and absorbed to the receiving member 146 due to capillary force of the receiving member 146 that contacts the mesh form portion 147*a*. The ink which is absorbed to the receiving member 146 moves downward inside the receiving member 146 along with the passage of time. Since the second receiving member 163 abuts with the lower surface of the receiving member 146 in the center portion, ink which is absorbed to the periphery of the center portion of the receiving member 146 is absorbed to the second receiving member 163 and is dropped (drips) on the ink receiving surface 130 within the chassis 128. In addition, the ink which is absorbed to the receiving member 146 at a position that is separated from the contact portion with the second receiving member 163 is dropped (drips) on the ink receiving surface 130 within the chassis 128 via the ink dropping ports 149*a* from the lower surface of the receiving member 146. Ink which is dropped on the receiving surface 130 is discharged to the waste ink tank via the discharge tube 126 from the discharge port 133.

Here, ink which is flushed from the liquid ejecting head 27 is charged on the positive side due to the Leonard effect. For this reason, when charging of ink which is adhered to the adhesion surface 170 does not proceed, ink which is adhered to the adhesion surface 170 and the ink droplet which is ejected tends to be repelled and misted. When the misted ink is adhered to the nozzle formation surface 61, there is a possibility of an adverse effect on ejection of ink from the nozzle 26, but in the flushing receptive body 129 and the printer 11 of the embodiment, since the fixing member 147 which is disposed further on the nozzle formation surface 61 side than the receiving member 146 contacts the receiving member 146, or is electrically grounded, it is possible to charge in a case where charged ink is adhered on the adhesion surface 170, and the fixing member 147 is held at a 0 position.

In addition, in the flushing receptive body 129 and the printer 11 of the embodiment, since the distance between the nozzle formation surface 61 and the adhesion surface 170 in the flushing operation is larger than a distance between the nozzle formation surface 61 and the support base 12 in ejection of ink on the recording medium 13, even in a case where adhered ink is misted in the flushing operation, it is possible to reduce adhesion of the mist on the nozzle formation surface 61. Furthermore, in the flushing receptive body 129 and the printer 11 of the embodiment, since a position of the mesh form portion 147*a* in the Z direction and the position of an upper surface of the frame body portion 145*a* in the Z direction are substantially the same, even in a case where adhered ink is misted in the flushing operation, mist tends not to be retained in a gap between the nozzle formation surface 61, the adhesion surface 170, and the frame body portion 145*a* and it is possible to reduce adhesion of mist on the nozzle formation surface 61.

In addition, in the flushing receptive body 129 and the printer 11 of the embodiment, since the receiving member holding portion 145 is formed by a synthetic resin material with conductivity, it is possible to easily electrically ground ink and the fixing member 147 that are held by the receiving member 146, and it is possible to inexpensively manufacture a member that has a complex part such as the locking portion 145*c* or the hook portion 152. In addition, in the flushing receptive body 129 and the printer 11 of the embodiment, it is possible to easily electrically ground the fixing member 147 and the receiving member holding portion 145 by the receiving member holding portion 145 contacting the grounding member 161 due to a simple operation such that the flushing receptive body 129 is mounted on the chassis 128.

Printing Method

Next, the printing method in which the printer 11 is used will be described. In the printing method of the embodiment, at a frequency according to the type of recording medium 13, the maintenance operation described above (capping operation and wiping operation) is carried out.

That is, since the recording medium 13 that is difficult to discharge in a case where the charged ink is adhered tends to be in a state of being charged to the positive side, ink that is charged to the positive side in subsequent ejection and reaches the recording medium 13 tends not to adhere, and is repelled and misted in a situation of tending to be adhered to the nozzle formation surface 61. In particular, in a case where the transport roller which contacts the ink adhesion surface side of the recording medium 13 has fluorine or a front surface that is subjected to fluorine-processing, since a fluorine resin is mostly on the negative side of a charge row, in the case of the recording medium 13 in which polyethylene, polyester, polypropylene, and the like are used, in the charge row the recording medium 13 tends to be charged to the positive side in comparison to polyvinyl chloride (PVC) that is close to the fluorine resin. For this reason, when the printing operation is performed using such a recording medium 13, frequency at which the maintenance operation is performed is increased.

In the embodiment, the case of using five types of media as the recording medium 13 of a medium M1 (PVC film), a medium M2 (a two layer structure of the printing surface on the PVC film and a non-printing surface of the polyester film), a medium M3 (polyester film), a medium M4 (fabric 1 of synthetic fiber), and a medium M5 (fabric 2 of synthetic fiber) will be described.

FIG. 15 is a diagram illustrating a distance PG (mm) between the nozzle formation surface 61 and the medium, temperature and humidity, mist attachment degree on the nozzle formation surface 61, charge amount (V) on the printing surface after printing of a predetermined area ($S(m^2)$) is performed, charge amount (V) of the non-printing surface, and amount of increase in charge (charge amount of the printing surface−charge amount of the non-printing surface) (V) in each medium M1 to M5. Note that, concerning medium M3, a charge amount after printing of approximately half S/2 ($m^2$) of the other media M1 and M2, and M4 and M5 is performed is indicated.

Since the medium with a large amount of increase in charge indicated in FIG. 15 tends not to be discharged in a case where the printing surface is charged, it is considered that mist tends to be adhered to the nozzle formation surface 61. In addition, in a case where the distance PG between the nozzle formation surface 61 and the medium is large, since flight distance and flight time of the ejected ink droplet are long, it is considered that there is a large amount in which the ink droplet tends to be misted and is adhered to the nozzle formation surface 61. Furthermore, according to the type of media, the printing surface tends to be charged to positive by contacting the transport portion 14. For this reason, in the embodiment, as shown in FIG. 16, according to the discharge characteristic (charging characteristic) of the media M1 to M5, a first coefficient A is set so as to be large enough for the medium in which the amount of increase in charge is large, according to the size of the distance PG between the nozzle formation surface 61 and the medium, a second coefficient B is set so as to be large enough for the medium in which the distance PG is large, and according to the contact with the transport portion 14, a third coefficient C is set so as to be large enough for the medium in which the printing surface tends to be charged to positive due to contact with the transport portion 14. The control portion 39 carries out the maintenance operation on the nozzle formation surface 61 in a case where a value where at least a portion of the coefficient is multiplied by the number of liquid droplets that are ejected on the medium reaches a predetermined threshold.

The number of liquid droplets of ink (shot) that is ejected on the recording medium (medium) 13 during printing is n and a threshold T at which the maintenance operation is carried out is described as 100×108.

First Embodiment

In a first embodiment, the first coefficient A and the second coefficient B are used, the number of liquid droplets n which are ejected on the medium satisfies Formula (1) below, and in a case of reaching the threshold T, the control portion 39 carries out the maintenance operation (capping suction and wiping described above (routine CL)) on the nozzle formation surface 61.

$$T \leq n \times A \times B \quad (1)$$

FIG. 17 illustrates a relationship between the distance PG in each medium M1 to M5 and the number n of liquid droplets by which the maintenance operation is carried out. As shown in FIG. 17, it is difficult to discharge in a case where the printing surface is charged, and the maintenance operation is carried out at a number by which the number of liquid droplets that are ejected on the medium is small to be enough for a medium in which the distance PG between the nozzle formation surface 61 and the medium is large.

In a case where the liquid droplets of the charged ink are adhered to the ink adhesion surface of the media M1 to M5, since the ink adhesion surface that is enough for the medium that is difficult to discharge tends to be charged at the same polarity as the liquid droplets, the ink adhesion surface on which the liquid droplets of the ejected ink are charged at the same polarity is repelled, the amount of adhesion to the nozzle formation surface 61 is great, but in the printing method of the first embodiment, it is possible to perform the maintenance operation on the nozzle formation surface 61 at a frequency corresponding to the discharge properties of the media M1 to M5 by setting the first coefficient A. In addition, in the printing method of the first embodiment, it is possible to perform the maintenance operation at a frequency corresponding to the distance PG to the nozzle formation surface 61 of the media M1 to M5 by setting the second coefficient B.

Accordingly, in the printing method of the embodiment, it is possible to perform the maintenance operation on the nozzle formation surface 61 at an appropriate timing and frequency according to the charging properties and the discharge properties of the media M1 to M5. In addition, in the printing method of the embodiment, it is possible to carry out the maintenance operation on the nozzle formation surface 61 at an appropriate timing and frequency even in a case where there is a great change for mist to adhere to the nozzle formation surface 61 due to an operation being performed a plurality of times in which ink is ejected with respect to the same scanning region as the ink adhesion surface of the recording medium 13 while scanning the liquid ejecting head 27 described above.

Second Embodiment

In a second embodiment, the first coefficient A, the second coefficient B, and the third coefficient C are used, the number of liquid droplets n which are ejected on the medium satisfies Formula (2) below, and in a case of reaching the threshold T, the control portion 39 carries out the maintenance operation (capping suction and wiping described above) on the nozzle formation surface 61.

$$T \leq n \times A \times B \times C \quad (2)$$

FIG. 18 illustrates a relationship between the distance PG in each medium M1 to M5 and a number n of liquid droplets by which the maintenance operation is carried out. As shown in FIG. 18, it is difficult to discharge in a case where the printing surface is charged, and the maintenance operation is carried out at a number by which the number of liquid droplets that are ejected on the medium is small to be enough for a medium in which the distance PG between the nozzle formation surface 61 and the medium is large, and furthermore, the printing surface tends to be charged to positive due to contact with the transport portion 14.

In this manner, in the printing method of the second embodiment, it is possible to perform the maintenance operation at a frequency corresponding to the degree to which the printing surface tends to be charged due to contact with the transport portion 14 of the media M1 to M5 by setting the third coefficient C in addition to the actions and effects that are obtained in the same manner as the printing method of the first embodiment.

Third Embodiment

In a third embodiment, with respect to the first embodiment in which the first coefficient A and the second coefficient B are used, as shown in FIG. 19, concerning the media M1 to M2 and the media M4 to M5 excluding the medium M3 that has a different printing area, the maintenance operation is carried out after the liquid droplet number is ejected when the distance PG=2.5 on the medium M4 on which the maintenance operation is carried out at a minimum liquid droplet number within the media M1 to M2 and M4 to M5 when the distance PG=2.0 and 2.5. Note that, when the distance PG=1.65, the number of liquid droplets that are ejected is doubled until the maintenance operation is carried out since the amount of mist that is adhered to the nozzle formation surface 61 is smaller than when the distance PG=2.0 and 2.5.

In this manner, in the printing method of the third embodiment, since the maintenance operation is carried out under conditions in which the distance PG=2.5 of the medium M4 that has the greatest amount of mist that is adhered to the nozzle formation surface 61, it is possible to increase safety by executing the maintenance operation before the amount of mist that is adhered to the nozzle formation surface 61 becomes great and easily manage the liquid droplet number that is ejected until the maintenance operation is carried out in addition to the actions and effects that are obtained in the same manner as the printing method of the first embodiment.

Fourth Embodiment

In the first to third embodiments, the maintenance operation is carried out according to the number of ejected liquid droplets, but as shown in FIG. 20, in Embodiment 4, not only the liquid droplet number, but the threshold of the liquid droplet number that is indicated in FIG. 19 in the third embodiment is set in the printing area that corresponds to the liquid droplet number. In the embodiment, the control portion 39 carries out the maintenance operation on the nozzle formation surface 61 when reaching the printing area where the printing area of the medium is set as the threshold.

In this manner, in the printing method of the fourth embodiment, since the printing area of the medium is used as the threshold for executing the maintenance operation, for example, it is possible to carry out the maintenance operation at an appropriate timing even in a case where variation occurs in the amount of liquid droplets that are ejected from the liquid ejecting head 27 in addition to the actions and effects that are obtained in the same manner as the printing method of the third embodiment.

Note that, in the first to fourth embodiments, a count of the liquid droplet number of ink up until that point is reset and counted in a case where wiping or suction maintenance is carried out for another reason (for example, maintenance is carried out in which foreign matter on the nozzle formation surface is removed by detecting a defective nozzle using a dot missing detection device and the like) during the printing operation.

Although appropriate embodiments are described above while referring to the drawings, needless to say, the invention is not limited to the examples. Various forms, combinations, and the like of each configuring member which is indicated in the examples are described above as examples, and various modifications are possible based on design requirements and the like within a range not deviating from the gist of the invention.

For example, in the embodiments described above, although an example is exemplified in which the non-water-based ink is used, the embodiments are not limited thereto and a water-based ink may be used. In the water-based pigment ink, particles of multiple pigments are dispersed within the liquid that is used as a dispersion medium. Organic pigments with an average particle diameter of approximately 100 nm as the pigments of cyan, magenta, and yellow, carbon black (inorganic pigments) with average particle diameter of approximately 120 nm as the black pigment, titanium oxide (inorganic pigments) with average particle diameter of approximately 320 nm as the white pigment, and the like may be used.

In addition, the embodiments described above are configured to have the frame body portion 145*a* of the receiving member holding portion 145 with a uniform height, but for example, may be configured to suppress adhesion of mist to the nozzle formation surface 61 by forming an escape route for air by cutting away a portion of the frame body portion 145*a*. In addition, the embodiments may be configured so not to have the frame body portion 145*a* and have only the beam member 149 for supporting the receiving member 146 by the receiving member holding portion 145. In addition, a configuration is exemplified in which the receiving member holding portion 145 is formed by a synthetic resin with conductivity, but there may be a configuration in which the receiving member holding portion 145 is used that made of metal.

In addition, as the chassis 128 which is described in the embodiments above, there may be a configuration in which on the side wall of the chassis 128 at least one of the +Y side and the −Y side of the scanning region of the liquid ejecting head 27 is caused to protrude further to the +Z side (the −Y side protrudes in FIGS. 6 and 7) than the adhesion surface 170 since the resin member has a characteristic of tending to be charged to the negative side. By adopting this configuration, it is possible to adsorb using the side wall to which the mist that is charged to the positive side projects.

The embodiments of the printing method described above exemplify a configuration in which a threshold that uses the first coefficient A and the second coefficient B or a threshold that uses the first coefficient A to the third coefficient C is set, but in addition, there may be a configuration in which a threshold that uses the first coefficient A and the third coefficient C is set.

In addition, in the embodiments described above, a configuration is exemplified in which the type of the recording medium 13, the size of the distance PG between the nozzle formation surface 61 and the medium, and contact with the transport portion 14 are set as reference items for executing the maintenance operation on the nozzle formation surface 61, but the embodiments are not limited to this configuration, and for example, may have a configuration in which a detector is provided which detects atmospheric humidity in the printing region, the maintenance operation is carried out in a case where the humidity is lower than a predetermined value, and the like, and atmospheric humidity in the printing region is set as the reference item.

The cover member 60 that is indicated in the embodiments described above may suppress charging of the nozzle 26 and the ink droplet which is ejected from the nozzle 26 to the positive side by applying a negative voltage. In addition, a surface treatment (fluorine resin coating treatment) or the like in which it is easy to charge to negative due to friction with air flow may be carried out on the front surface of the cover member 60. In this case, it is preferable to electrically ground a part that is caused to contact the cover member 60 in the wiper unit 46 and the capping unit 48 and destaticize the cover member 60 during the maintenance operation. Furthermore, the region in which the surface treatment is carried out on the front surface of the cover member 60 may be set, for example, as the outside of the part that contacts the capping unit 48.

In the embodiments described above, a configuration is exemplified in which printing is performed by performing a plurality of times an operation in which ink is ejected with respect to the same scanning region as the ink adhesion surface of the recording medium 13 while scanning the liquid ejecting head 27, but printing may be performed by performing the operation one time in which ink is ejected with respect to the same scanning region as the ink adhesion surface of the recording medium 13. In this case, since it is considered that adhesion to the nozzle formation surface 61 is slight due to repelling of the ink adhesion surface on which the liquid droplets of discharged ink are charged with the same polarity, the first coefficient A may be set to a smaller value than in a case where printing is performed by performing a plurality of times an operation in which ink is ejected with respect to the same scanning region as the ink adhesion surface of the recording medium 13.

In the embodiments described above, a configuration is exemplified in which the transport roller that contacts the ink adhesion surface side of the recording medium 13 has fluorine or a front surface that is subjected to fluorine-processing, but the front surface of the transport roller which contacts the ink adhesion surface side of the recording medium 13 may be configured by another material, for example, nylon or the like on the positive side using fluorine in the charge row. In this case, in comparison to the configuration in which the transport roller has fluorine or a front surface that is subjected to fluorine-processing, it is possible to reduce the degree of charge on the positive side of the recording medium 13 in which polyethylene, polyester, polypropylene, and the like are used.

The liquid ejecting apparatus described as the printer 11 may be a liquid ejecting apparatus that ejects and discharges another liquid other than ink. Note that, the state of the liquid which is discharged in a liquid droplet in a very small amount from the liquid ejecting apparatus is set to include pulling out in a tail a granular shape, a tear shape, and a yarn shape. In addition, the liquid here may be a material that it is possible to eject from the liquid ejecting apparatus. For example, it is sufficient if the material is in a state when a substance is in a liquid phase, and the material includes a fluid state body such as a liquid state body having high or low viscosity, a sol, a gel, and other materials such as an inorganic solvent, an organic solvent, a solution, a liquid state resin, and a liquid metal (molten metal). In addition, the state of the substance is not limited only to liquid, and a substance where particles of a functional material made from a solid substance such as a pigment or metallic particles are dissolved, dispersed, mixed, or the like in a solvent are included. As a representative example of liquid examples are given such as ink and liquid crystal which are described in the embodiment described above. Here, ink contains various types of liquid-form compositions such as a typical water-based ink, oil-based ink, gel ink, and hot melt ink. As a specific example of the liquid ejecting apparatus, for example, there is a liquid ejecting apparatus which ejects liquid that includes a material such as an electrode material or a color material which is used in manufacture and the like of a liquid crystal display, an electro-luminescence (EL) display, a surface light emission display, and a color filter in a dispersed or dissolved form. In addition, the apparatus may be a liquid ejecting apparatus which ejects a bio-organic material that is used in biochip manufacture, a liquid ejecting apparatus which ejects liquid that is a sample that is used as a precision pipette, a textile printing apparatus, a micro dispenser, and the like. Furthermore, the apparatus may be a liquid ejecting apparatus which ejects lubricant oil with pinpoint precision in precision machinery such as a watch or a camera and a liquid ejecting apparatus which ejects a transparent resin liquid such as an ultraviolet curable resin on a substrate in order to form a micro-spherical lens (an optical lens) or the like which is used in an optical communication element or the like. In addition, the apparatus may be a liquid ejecting apparatus which ejects acidic or alkaline etching liquid in order to carry out etching on a substrate or the like.

The entire disclosure of Japanese Patent Application No. 2015-207379, filed Oct. 21, 2015 is expressly incorporated by reference herein.

What is claimed is:

1. A liquid ejecting apparatus comprising:

a liquid ejecting portion, which has a nozzle formation surface on which a nozzle that ejects liquid is formed, and ejects the liquid on a medium from the nozzle; and a flushing receptive body which receives the liquid that is ejected in a flushing operation in which the liquid is ejected from the nozzle as a maintenance operation of the liquid ejecting portion, wherein the flushing receptive body includes a receiving member that is able to receives the liquid, a receiving member holding portion which holds the receiving member such that the receiving member faces the nozzle formation surface in the flushing operation, the receiving member holding portion being formed of a synthetic resin material that has conductivity, and a fixing member that fixes the receiving member to the receiving member holding portion by contacting the receiving member, and in the flushing operation, is positioned on the nozzle formation surface side due to the receiving member, and has a mesh form portion that forms an adhesion surface to which the ejected liquid is adhered with the receiving member, and is formed of a metal material that has conductivity, and the fixing member is electrically grounded via the receiving member holding portion electrically grounded by a metal grounding member.

2. The liquid ejecting apparatus according to claim 1, further comprising:

a medium support portion which supports the medium when the liquid is ejected on the medium, wherein a distance between the nozzle formation surface and the adhesion surface in the flushing operation is larger than a distance between the nozzle formation surface and the medium support portion in ejection on the medium.

3. The liquid ejecting apparatus according to claim 1, wherein the receiving member holding portion has a side wall that is provided to surround the receiving member, and the side wall is provided with a region in which a distance to the nozzle formation surface in the flushing operation is the same as or larger than a distance between the nozzle formation surface and the adhesion surface of the fixing member.

4. The liquid ejecting apparatus according to claim 1, wherein the receiving member holding portion has a locking portion that locks a locked portion of the fixing member such that the fixing member is electrically grounded via the receiving member holding portion.

5. The liquid ejecting apparatus according to claim 4, further comprising:

a flushing receptive body mounting body which holds the flushing receptive body to be attachable and detachable, the flushing receptive body mounting body being formed of a synthetic resin material; and the metal grounding member which has conductivity is fixed to the flushing receptive body mounting body so as to contact the receiving member holding portion when the flushing receptive body is mounted on the flushing receptive body mounting body.

6. The liquid ejecting apparatus according to claim 5, wherein the flushing receptive body mounting body has lower conductivity than the receiving member holding portion and has a part located on the liquid ejecting portion side than the receiving member so as not to contact the liquid ejecting portion in a direction in which the liquid is ejected from the nozzle in the flushing operation.

7. A flushing receptive body receiving liquid that is ejected in a flushing operation in which the liquid is ejected from a nozzle as a maintenance operation of a liquid ejecting portion that has a nozzle formation surface on which the nozzle that ejects the liquid is formed, and ejects the liquid on the medium from the nozzle, the flushing receptive body comprising:

a receiving member that receives the liquid;

a receiving member holding portion which holds the receiving member such that the receiving member faces the nozzle formation surface in the flushing operation, the receiving member holding portion being formed of a synthetic resin material that has conductivity; and a fixing member that fixes the receiving member to the receiving member holding portion by contacting the receiving member, and in the flushing operation, is positioned on the nozzle formation surface side due to the receiving member, and has a mesh form portion that forms an adhesion surface to which the ejected liquid is adhered with the receiving member, and is formed of a metal material that has conductivity, wherein the receiving member holding portion has a locking portion that locks a locked portion of the fixing member, and has a grounded portion that is able to contact a metal grounding member such that the fixing member is electrically grounded via the receiving member holding portion.

8. A liquid ejecting apparatus comprising:

a liquid ejecting portion, which has a nozzle formation surface on which a nozzle that ejects liquid is formed, and ejects the liquid on a medium from the nozzle;

a flushing receptive body which receives the liquid that is ejected in a flushing operation in which the liquid is ejected from the nozzle as a maintenance operation of the liquid ejecting portion, the flushing receptive body including an adhesion surface to which the ejected liquid is adhered in the flushing operation and being electrically grounded; and a medium support portion which supports the medium when the liquid is ejected on the medium, wherein a distance between the nozzle formation surface and the adhesion surface in the flushing operation is larger than a distance between the nozzle formation surface and the medium support portion in ejection on the medium.

9. The liquid ejecting apparatus according to claim 8, further comprising:

a flushing receptive body mounting body which holds the flushing receptive body, wherein the flushing receptive body mounting body is formed of a synthetic resin material having lower conductivity than the flushing receptive body and has a part located on the liquid ejecting portion side than the adhesion surface of the flushing receptive body so as not to contact the liquid ejecting portion in a direction in which the liquid is ejected from the nozzle in the flushing operation.

10. The liquid ejecting apparatus according to claim 9, wherein the part is a side wall of the flushing receptive body mounting body that protrudes toward the liquid ejecting portion side than the adhesion surface and is located at a position adjacent to the adhesion surface in a direction crossing a scanning direction of the liquid ejecting portion.

* * * * *